US011060045B2

(12) United States Patent
Reiner et al.

(10) Patent No.: US 11,060,045 B2
(45) Date of Patent: Jul. 13, 2021

(54) PRODUCTION OF RENEWABLE WAXES AND BASE OILS

(71) Applicant: ExxonMobil Research and Engineering Company, Annandale, NJ (US)

(72) Inventors: Virginia M. Reiner, Summit, NJ (US); Michel Daage, Hellertown, PA (US); Kun Wang, Bridgewater, NJ (US); Chunping Wu, Whitehouse, NJ (US); Sarvesh K. Agrawal, Woolwich Township, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 62 days.

(21) Appl. No.: 15/626,647

(22) Filed: Jun. 19, 2017

(65) Prior Publication Data

US 2018/0010061 A1 Jan. 11, 2018

Related U.S. Application Data

(60) Provisional application No. 62/360,514, filed on Jul. 11, 2016.

(51) Int. Cl.
*C10L 1/22* (2006.01)
*C10M 109/02* (2006.01)
(Continued)

(52) U.S. Cl.
CPC ..... *C10M 109/02* (2013.01); *C10M 101/04* (2013.01); *C10M 105/20* (2013.01);
(Continued)

(58) Field of Classification Search
CPC ..... C10M 109/02; C10M 107/32; C10M 105/20; C10M 101/04; C10M 2205/143;
(Continued)

(56) References Cited

U.S. PATENT DOCUMENTS 6,063,144 A 5/2000 Calzada et al.
6,824,572 B2 11/2004 Murphy
(Continued)

FOREIGN PATENT DOCUMENTS

EP 457665 A1 11/1991
EP 0457665 A1 11/1991

OTHER PUBLICATIONS

Corma et al., Coupling Fatty Acids by Ketonic Decarboxylation Using Solid Catalysts for the Direct Production of Diesel, Lubricants, and Chemicals, ChemSusChem, Jul. 24, 2008, pp. 739-741, vol. 1, iss. 10, Wiley Online Library.
(Continued)

*Primary Examiner* — Prem C Singh
*Assistant Examiner* — Francis C Campanell
(74) *Attorney, Agent, or Firm* — Amanda K. Norwood; Kristina Okafor

(57) ABSTRACT

Systems and methods are provided for processing a feed derived from a renewable source to form oligomerized compounds corresponding to waxes, ketone waxes, and/or lubricant boiling range compounds. The oligomerized compounds derived from the renewable source can have various novel properties relative to waxes and/or lubricant boiling range compounds derived from mineral sources or derived from renewable sources in a conventional manner. The oligomerized compounds can be derived from a renewable source including fatty acids and/or fatty acid derivatives, such as glycerides (including triglycerides) and fatty amides.
(Continued)

Optionally but preferably, at least a portion of the fatty acids and/or fatty acid derivatives can include olefinic bonds.

8 Claims, 6 Drawing Sheets

(51) Int. Cl.

| | |
|---|---|
| ***C10M 101/04*** | (2006.01) |
| ***C10M 105/20*** | (2006.01) |
| ***C10M 107/32*** | (2006.01) |
| *C10N 20/02* | (2006.01) |
| *C10N 20/04* | (2006.01) |
| *C10N 20/00* | (2006.01) |
| *C10N 30/02* | (2006.01) |
| *C10N 30/00* | (2006.01) |

(52) U.S. Cl.
CPC ..... *C10M 107/32* (2013.01); *C10M 2205/14* (2013.01); *C10M 2205/143* (2013.01); *C10M 2205/18* (2013.01); *C10M 2207/085* (2013.01); *C10M 2207/401* (2013.01); *C10N 2020/02* (2013.01); *C10N 2020/04* (2013.01); *C10N 2020/067* (2020.05); *C10N 2020/081* (2020.05); *C10N 2030/02* (2013.01); *C10N 2030/64* (2020.05)

(58) Field of Classification Search
CPC ..... C10M 2205/14; C10M 2205/18; C10M 2207/085; C10M 2207/401; C10M 129/24; C10N 2230/02; C10N 2230/64; C10N 2220/026; C10N 2220/022
USPC ..... 508/452
See application file for complete search history.

(56) References Cited

U.S. PATENT DOCUMENTS

| | | | | |
|---|---|---|---|---|
| 6,890,982 | B2 | 5/2005 | Borsinger et al. | |
| 7,128,766 | B2 | 10/2006 | Murphy et al. | |
| 7,731,767 | B2 | 6/2010 | Tao | |
| 8,048,290 | B2 | 11/2011 | Knuuttila et al. | |
| 8,053,614 | B2 | 11/2011 | Aalto et al. | |
| 8,157,873 | B2 | 4/2012 | Murphy et al. | |
| 8,202,329 | B2 | 6/2012 | Murphy et al. | |
| 8,362,125 | B2 | 1/2013 | Gong et al. | |
| 8,529,924 | B2 | 9/2013 | Murphy et al. | |
| 8,652,221 | B2 | 2/2014 | Uptain et al. | |
| 2007/0135663 | A1 | 6/2007 | Aalto et al. | |
| 2007/0161832 | A1 | 7/2007 | Myllyoja et al. | |
| 2007/0249771 | A1 | 10/2007 | Paul et al. | |
| 2009/0014354 | A1 | 1/2009 | Knuuttila et al. | |
| 2013/0178640 | A1 | 7/2013 | Mujkic et al. | |
| 2013/0324449 | A1* | 12/2013 | Hommeltoft | C07C 45/41 508/577 |
| 2014/0024869 | A1 | 1/2014 | Roberts et al. | |
| 2014/0142356 | A1 | 5/2014 | Roberts et al. | |
| 2014/0171699 | A1 | 6/2014 | Wang et al. | |

OTHER PUBLICATIONS

Wu et al., "Alkylated Aromatics", Synthetics, Mineral Oils, and Bio-Based Lubricants, L.R. Rudnik, ed., Taylor & Francis, 2006, pp. 139-155, ch. 7.

Easterfield et al., "The Preparation of the Ketones of the Higher Fatty Acids", Journal of the Chemical Society, Jan. 1, 1911, pp. 2298-2307, vol. 99.

PCT/US2017/038134 International Search Report and Written Opinion dated Dec. 12, 2017.

* cited by examiner

PRODUCTION OF RENEWABLE WAXES AND BASE OILS

CROSS-REFERENCE TO RELATED APPLICATIONS

This application claims the benefit of U.S. Provisional Application No. 62/360,514, filed on Jul. 11, 2016, the entire contents of which is incorporated herein by reference.

FIELD

This invention relates to methods for processing biomass to make waxes and lubricant boiling range products.

BACKGROUND

Developing renewable sources of feedstocks based on biomass for making lubricants is an area of ongoing interest. Use of biomass as a feedstock source is attractive from a perspective of avoiding depletion of mineral oil and gas sources. However, a variety of challenges remain in developing technologies for harvesting and processing feeds derived from biomass.

One difficulty can be that renewable feeds are typically more likely to contain molecules with chain lengths and/or molecular weights corresponding to the diesel boiling range. For example, fatty acids present in some types of biomass typically have carbon chain lengths of 20 atoms or less, which usually corresponds to a diesel boiling range molecule. Biomass feeds with molecules having chain lengths in the lubricant base oil boiling range are currently less common. One option for making a lubricant base oil product from a feed containing fatty acids is to couple two or more fatty acid chains to create molecules with longer chain lengths.

European Patent Application No. EP 0457665 describes performing a condensation reaction on carboxylic acids or polyfunctional compounds such as triglycerides using a catalyst based on an iron-containing mineral, such as bauxite.

U.S. Pat. No. 8,048,290 describes a process for producing branched hydrocarbons. A feedstock derived from a biological starting material, such as a fatty acid or a fatty acid derivative, is subjected to a condensation step to produce hydrocarbons that also contain one or more heteroatoms, such as oxygen or nitrogen. The condensation product is then subject to a combined hydrodefunctionalization and isomerization step. In this combined step, isomerization and heteroatom removal are performed in the same step. Examples of suitable catalysts for performing the combined hydrodefunctionalization and isomerization step include alumina bound ZSM-23 or SAPO-11 with supported Pt as a hydrogenation metal. ZSM-48 is also mentioned as a suitable zeolite.

U.S. Pat. No. 8,053,614 describes a method for producing a base oil. In various options, triglyceride containing feeds are converted to fatty acids or fatty acid alkyl esters. The fatty acids or fatty acid esters are then used to form ketones via a condensation reaction. The ketones are then deoxygenated in a hydrogenation step to form paraffins, which were then isomerized. One or more distillation or separation steps are included at various points in the process of converting the triglyceride containing feed to the isomerized paraffin.

U.S. Patent Application Publication Nos. 2014/0024869 and 2014/0142356 describe methods for coupling fatty acid or fatty acid derivative carbon chains followed by hydroprocessing to form lubricant boiling range compounds.

U.S. Patent Application Publication No. 2014/0171699 describes methods for forming oligomers from fatty acid or fatty acid derivative carbon chains in the presence of an acidic or basic catalyst followed by hydroprocessing to form lubricant boiling range compounds.

SUMMARY

In an aspect, a ketone wax composition can be provided. The ketone wax can include at least about 80 wt % of compounds having a carbon chain length of 27 carbons to 39 carbons, or 30 carbons to 39 carbons. At least about 30 wt % of the compounds having a carbon chain length of 27 carbons to 39 carbons can comprise oxygenates. At least a portion of the oxygenates can comprise ketones. The ketone wax composition can comprise a kinematic viscosity at 100° C. of about 3.0 cSt to about 7.5 cSt and/or a melting point of at least about 78° C. The compounds having a carbon chain length of 27 carbons to 39 carbons can include at least about 20 wt % of compounds having a first carbon chain length, at least about 20 wt % of compounds having a second carbon chain length, and at least about 20 wt % of compounds having a third carbon chain length. Optionally, the largest difference in carbon chain length between any two of the first carbon chain length, the second carbon chain length, and the third carbon chain length can correspond to 6 carbons or less, or 4 carbons or less.

In an aspect, an oligomerized composition can be provided. The oligomerized composition can include at least about 70 wt % of compounds having a carbon chain length of 30 carbons to 70 carbons and optionally about 20 wt % or less of compounds having a carbon chain length of less than 30 carbons. The compounds having a carbon chain length of 30 carbons to 70 carbons can include about 30 wt % or less of compounds with a double bond equivalent value of 6 for each carbon chain length and/or about 20 wt % or less of compounds with a double bond equivalent value of 5 for each carbon chain length and/or about 20 wt % or less of compounds with a double bond equivalent value of 4 for each carbon chain length.

In an aspect, a method for forming a lubricant boiling range composition can be provided. The method can include oligomerizing a feed comprising fatty acids, fatty acid derivatives, or a combination thereof to form an oligomerized composition. The oligomerized composition can include at least about 25 wt % of compounds having a carbon chain length greater than 50 carbons and optionally about 25 wt % or less of compounds having a carbon chain length less than 30 carbons. Solvent extraction can be performed on a lubricant boiling range feedstock to form a raffinate fraction and an extract fraction. The extract fraction can comprise a higher wt % of aromatics than the raffinate fraction. At least a first portion of the raffinate fraction can be dewaxed under dewaxing conditions to form a dewaxed effluent. At least a second portion of the raffinate fraction can be hydrofinished to form a hydrofinished effluent. At least a portion of the oligomerized composition can be combined with the lubricant boiling range feedstock and/or an intermediate product and/or a final product from processing the lubricant boiling range feedstock. This can correspond to a) combining the at least a portion of the oligomerized composition with the lubricant boiling feedstock prior to performing the solvent extraction; b) combining the at least a portion of the oligomerized composition with at least one of the first portion of the raffinate fraction and the second portion of the raffinate fraction; c) combining the at least a portion of the oligomerized composition with the at least a portion of the dewaxed effluent; d) combining the at least a portion of the oligomerized composition with at least a portion of the hydrofinished effluent; or e) a combination of two or more of a)-d), or three or more of a)-d), or a combination of all of a)-d). Optionally, the first portion of the raffinate fraction can correspond to at least a portion of the hydrofinished effluent. Optionally, the second portion of the raffinate fraction can correspond to at least a portion of the dewaxed effluent.

In an aspect, a method for forming a lubricant boiling range composition is provided. The method can include oligomerizing a feed comprising fatty acids, fatty acid derivatives, or a combination thereof to form an oligomerized composition. The oligomerized composition can include at least about 25 wt % of compounds having a carbon chain length greater than 50 carbons and optionally about 25 wt % or less of compounds having a carbon chain length less than 30 carbons. A lubricant boiling range feedstock can be hydrocracked to form a hydrocracked effluent. At least a first portion of the hydrocracked effluent can be dewaxed under dewaxing conditions to form a dewaxed effluent. At least a second portion of the hydrocracked effluent can be hydrofinished to form a hydrofinished effluent. At least a portion of the oligomerized composition can be combined with the lubricant boiling range feedstock and/or an intermediate product and/or a final product from processing the lubricant boiling range feedstock. This can correspond to a) combining the at least a portion of the oligomerized composition with the lubricant boiling feedstock prior to performing the hydrocracking; b) combining the at least a portion of the oligomerized composition with at least one of the first portion of the hydrocracked effluent and the second portion of the hydrocracked effluent; c) combining the at least a portion of the oligomerized composition with the at least a portion of the dewaxed effluent; d) combining the at least a portion of the oligomerized composition with at least a portion of the hydrofinished effluent; or e) a combination of two or more of a)-d), or three or more of a)-d), or a combination of all of a)-d). Optionally, the first portion of the hydrocracked effluent can correspond to at least a portion of the hydrofinished effluent. Optionally, the second portion of the hydrocracked effluent can correspond to at least a portion of the dewaxed effluent.

DETAILED DESCRIPTION OF THE EMBODIMENTS

Figure 1:
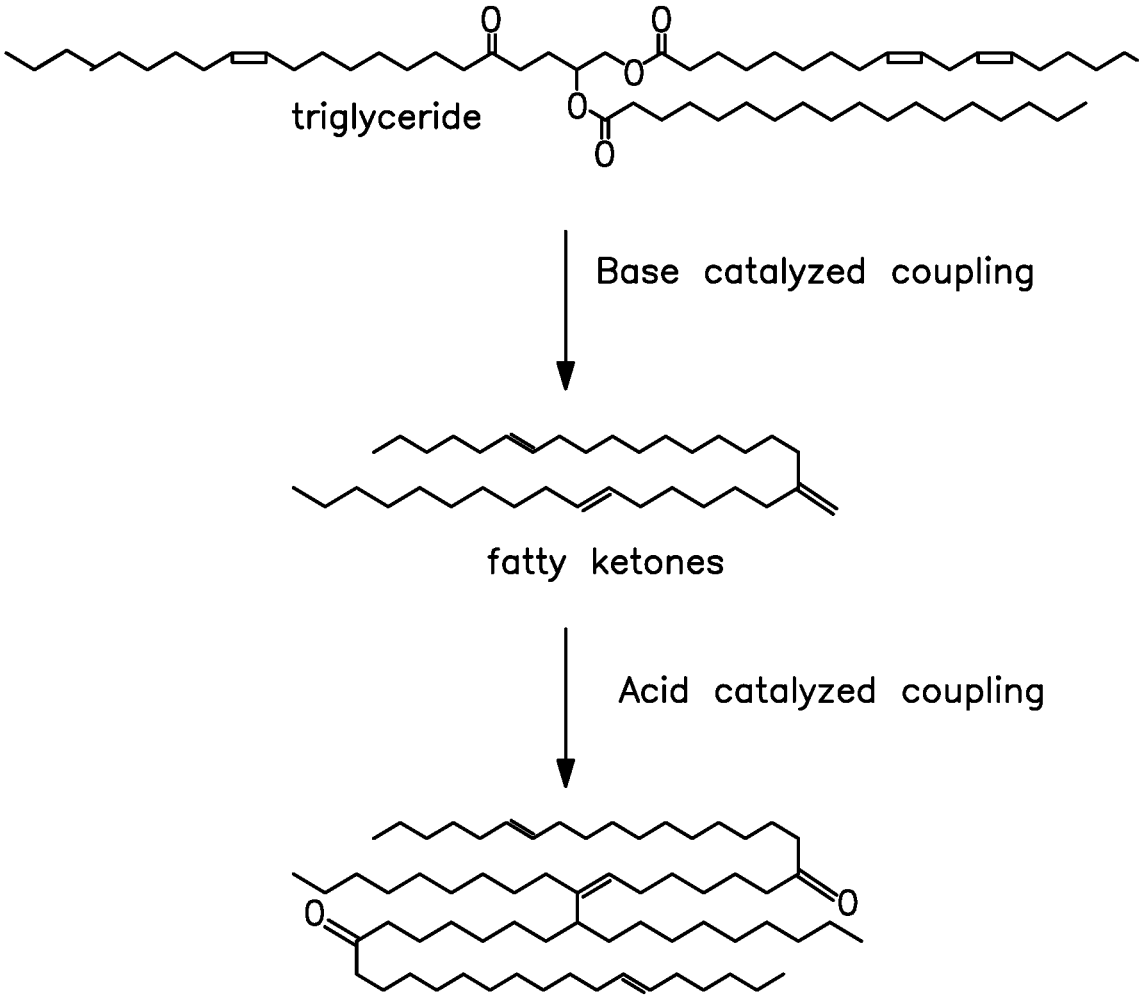
FIG. 1 shows reaction sequences for converting fatty acids and/or fatty acid derivatives into an oligomerized product.

In various aspects, systems and methods are provided for processing a feed derived from a renewable source to form oligomerized compounds corresponding to waxes, ketone waxes, and/or lubricant boiling range compounds. The oligomerized compounds derived from the renewable source can have various novel properties relative to waxes and/or lubricant boiling range compounds derived from mineral sources or derived from renewable sources in a conventional manner. The oligomerized compounds can be derived from a renewable source including one or more of fatty acids and/or fatty acid derivatives, such as glycerides (including triglycerides) and fatty amides. Optionally but preferably, at least a portion of the fatty acids and/or fatty acid derivatives can correspond to unsaturated compounds.

In some aspects, the oligomerized compounds can be derived in part by first exposing the feed to a basic catalyst under conditions suitable for coupling carbon chains from the feed to form a composition including a ketone wax. The catalyst can be effective for converting the fatty acids and/or fatty acid derivatives in the feed into ketones corresponding to a "dimer" of two fatty chains from the feed. Such a coupling reaction can optionally result in production of small molecule(s) containing heteroatoms eliminated during the conversion reaction, such as water, ammonia, carbon monoxide, and/or carbon dioxide. Such small molecules can be separated from the effluent of the coupling reaction in any convenient manner, such as by performing a separation based on boiling point. This initial coupling reaction can be used to make lubricant boiling range compounds, such as ketone waxes, having a carbon chain length of 27 to 39 carbons, advantageously with a relatively narrow distribution of carbon chain lengths. These ketone waxes can optionally undergo further processing, for example, to at least partially or fully saturate any olefin linkages present in the carbon chain and/or to at least partially or fully remove oxygen from the ketone wax. Such ketone waxes and/or further processed derivatives of such ketone waxes can potentially have unexpected properties relative to waxes derived from other/conventional sources.

In some aspects, an advantage of forming ketone wax from a renewable feed source can be related to the position of the ketone in the ketone wax. A ketone wax formed from a renewable feed can tend to correspond to ketones formed by coupling of fatty acid (and/or fatty acid derivative) type compounds. The ketones formed from coupling of fatty acid (and/or fatty acid derivative) type compounds with similar chain lengths can tend to have a ketone group located near the center of the compound. This can be in contrast to ketones made by functionalizing a paraffin feed, where the selectivity for forming a ketone near the center of the compound can be lower. In some aspects, at least 50 wt % of the ketones in a ketone wax can correspond to ketones with a ketone functional group near the center of the compound, or at least 70 wt %, or at least 90 wt %, such as up to 100 wt %. In some aspects, at least 50 wt % of the ketones in a ketone wax can correspond to ketones with a ketone functional group on the center carbon atom of the compound, or at least 70 wt %, or at least 90 wt %, such as up to 100 wt %. Having ketones located near the center of the compound (and/or on the center carbon atom of the compound) can potentially be beneficial, for example, for providing a ketone wax with higher crystallinity and/or wax-like properties. This can be due to the (relative) symmetry of ketones with a ketone functional group at or near the central carbon atom in a compound.

A ketone functional group can be considered as near the center of the ketone when the ketone functional group is located on a carbon atom within 5 carbon atoms of the center of the ketone compound. The center of a ketone compound can be determined based on the chain length of the ketone according to IUPAC naming rules. The center of a carbon chain can be defined by adding one to the chain length according to IUPAC naming rules and then dividing by two, with the resulting number corresponding to the center carbon atom. As an example, for a carbon chain length of 25, the center carbon atom can correspond to the thirteenth carbon atom from an end of the chain (i.e., [25+1]/2=13). For a carbon chain with an even number of carbon atoms according to IUPAC naming rules, adding one to the chain length and then dividing by two can result in a fractional number. The two carbon atoms corresponding to rounding up and rounding down of the fractional number can both be considered center carbon atoms.

It can be noted that although the distribution of carbon chain lengths can be narrow, the ketone wax compositions described herein can have a distribution of carbon chain lengths due to the nature of how the compositions are made. For the compounds in a ketone wax composition having a carbon chain length of 27 carbons to 39 carbons, the compounds can include at least three different chain lengths in substantial amounts. For example, the compounds having a carbon chain length of 27 carbons to 39 carbons can include at least 15 wt % (or at least 20 wt %) of compounds having a first carbon chain length, at least 15 wt % (or at least 20 wt %) of compounds having a second carbon chain length, and at least 15 wt % (or at least 20 wt %) of compounds having a third carbon chain length. Optionally, the largest difference in carbon chain length between any two of the first carbon chain length, the second carbon chain length, and the third carbon chain length can be 6 carbons or less, or 4 carbons or less.

As a complement to or as an alternative to the coupling reaction described above to form ketone waxes, additional oligomerization (such as additional dimerization or trimerization) can be performed to form still heavier oligomerized compounds. Such additionally oligomerized compounds can correspond to high viscosity lubricant base stocks with unexpected properties. Such additionally oligomerized compounds can optionally be further processed to improve the lubricant properties of the high viscosity base stock.

Additionally or alternately, the ketone waxes and/or additionally oligomerized compounds can be used to provide additional wax content for a mineral oil having a relatively low (reduced/minimized) wax content. Addition of ketone waxes and/or additionally oligomerized compounds derived from renewable sources can improve the suitability of a low wax content mineral oil for use in production of lubricant base stocks.

Ketone Wax Products and Properties

In some aspects, a ketone wax composition can be produced by a coupling reaction to exhibit an unexpected set of properties relative to conventional hydrocarbon lubricants. Optionally, the ketone wax composition can correspond to a composition separated from the initial effluent generated by a coupling reaction. The ketone wax composition formed by the methods described herein can include compounds with carbon chain lengths of 27 carbons to 39 carbons, or 30 carbons to 39 carbons. In various aspects, the ketone wax composition can include at least 80 wt %, or at least 90 wt %, or at least 95 wt % (such as up to 100 wt %) of compounds having a carbon chain length of 27 carbons to 39 carbons, or 30 carbons to 39 carbons. The ketone wax composition can also include a ketone functional group for at least a portion of the compounds having a carbon chain length of 27 carbons to 39 carbons (or 30 carbons to 39 carbons). In some aspects where no additional hydroprocessing is performed, the ketone wax composition can substantially correspond to ketone compounds, with at least about 80 wt % of the compounds having 27 carbons to 39 carbons (or 30 carbons to 39 carbons) in the ketone wax composition corresponding to ketones, or at least about 90 wt %, or at least about 95 wt %, such as up to about 100 wt %. In some aspects, the ketone wax composition can include a sufficient number of oxygenates (such as ketones) to provide unexpected properties in comparison with a conventional wax product. For example, about 30 wt % to about 100 wt % of the compounds having 27 carbons to 39 carbons (or 30 carbons to 39 carbons) can correspond to oxygenates (such as ketones), or about 40 wt % to about 90 wt %, or about 50 wt % to about 80 wt %.

In some aspects, the distribution of carbon chain lengths in the compounds having 27 carbons to 39 carbons (or 30 carbons to 39 carbons) can be relatively narrow. In such aspects, a substantial portion of the carbon chain lengths can correspond to compounds that differ in chain length by 6 carbons or less, or 4 carbons or less. As an example, a composition including compounds having a chain length of 31 carbons, 33 carbons, and 35 carbons can correspond to a composition with compounds that differ by 4 carbons or less. In such aspects, at least 80 wt % of the compounds having 27 carbons to 39 carbons (or 30 carbons to 39 carbons) can have chain lengths that differ by about 6 carbons or less, or about 4 carbons or less, or at least 90 wt %, or at least 95 wt %.

Additionally or alternatively, the compounds having 27 carbons to 39 carbons (or 30 carbons to 39 carbons) can have varying degrees of unsaturation. Because the ketone wax composition may not be further hydroprocessed and/or may be hydroprocessed under conditions for less than full deoxygenation, the ketone wax composition can optionally retain a substantial portion of olefinic bonds/compounds. For example, the ketone wax composition can include at least about 20 wt % of olefins, such as at least about 30 wt %, at least about 40 wt %, at least about 50 wt %, at least about 60 wt %, or at least about 70 wt %. Additionally or alternately, the ketone wax composition can include about 100 wt % olefins or less, such as about 90 wt % or less, about 80 wt % or less, about 70 wt % or less, about 60 wt % or less, or about 50 wt % or less. In particular, about 20 wt % to about 100 wt % of the compounds having 27 carbons to 39 carbons (or 30 carbons to 39 carbons) can correspond to olefins, or about 30 wt % to about 90 wt %, or about 40 wt % to about 70 wt %. To be clear, olefins have olefinic bonds and can simultaneously have other characteristics besides double bonds, such as oxygenate functionalities (e.g., ketones).

A ketone wax composition as described herein can have an unexpected combination of properties that can be beneficial in various types of end product applications. For example, for a ketone wax composition having a specified viscosity, the hardness of a ketone wax composition can be comparable to the hardness for a conventional paraffin wax composition having a similar viscosity. However, the melt point of such a ketone wax composition can be substantially higher than the corresponding paraffin wax having a similar viscosity. This can allow ketone wax compositions to be valuable for use in hot melt adhesive applications.

In various aspects, a ketone wax composition can have a kinematic viscosity at 100° C. of at least about 3.0 cSt, such as at least about 3.5 cSt, at least about 4.0 cSt, at least about 4.5 cSt, at least about 5.0 cSt, at least about 5.5 cSt, or at least about 6.0 cSt. Additionally or alternately, a ketone wax composition can have a kinematic viscosity of about 7.5 cSt or less, such as about 7.0 cSt or less, about 6.5 cSt or less, or about 6.0 cSt or less. In particular, a ketone wax composition can have a kinematic viscosity at 100° C. of about 3.0 cSt to about 7.5 cSt, or about 3.0 cSt to about 6.5 cSt, or about 4.0 cSt to about 7.5 cSt. The hardness of the ketone wax composition can be characterized based on needle penetration at 25° C. and/or 40° C., e.g., using ASTM D1321. For penetration at 25° C., the ketone wax composition can have a hardness value of about 6.0 or less, or about 5.5 or less, such as down to about 4.0. For penetration at 40° C., the ketone wax composition can have a hardness value of about 8.0 or less, or about 7.5 or less, such as down to about 5.0.

In various aspects, a ketone wax composition can have an unexpectedly high melting point relative to the melting point that would be expected for a paraffin wax composition of similar chain length. For example, a $C_{36}$ paraffin wax (i.e., a paraffin wax composed of 100% alkanes with 36 carbons in the carbon chain) can have a melting point of about 76° C., while a $C_{35}$ ketone wax (100% $C_{35}$ ketones) can have a melting point of about 86° C. A paraffin wax with a melting point of about 86° C. can correspond to a much heavier paraffin wax, such as a $C_{44}$ paraffin wax. However, a $C_{44}$ paraffin wax can have a substantially greater kinematic viscosity at 100° C. in comparison with a $C_{35}$ ketone wax. The kinematic viscosity of a $C_{44}$ paraffin wax can be at least about 11 cSt, while the kinematic viscosity of a $C_{35}$ ketone wax can be about 6.0 cSt. For commercial applications such as free standing candles, the unexpected combination of low kinematic viscosity and high melting point provided by a ketone wax composition can provide substantial advantages. ASTM D4419 describes methods for determining transition temperatures (such as melting point) for wax compositions using differential scanning calorimetry. For melting points described herein, DSC curves were generated using a method similar to ASTM D4419. For melting points described herein, peak melting points can be determined as a peak melting temperature during the heating part of the DSC curve during a second heating cycle of the material, after the heat history of the sample had been erased in the first heating cycle More generally, a ketone wax composition can be characterized based on a combination of kinematic viscosity at 100° C. and melting point. In some aspects, a ketone wax composition can have a kinematic viscosity at 100° C. of about 6.0 cSt to about 7.5 cSt and can have a melting point of at least about 83° C. In some aspects, a ketone wax composition can have a kinematic viscosity of about 3.0 cSt to about 7.5 cSt and a melting point of at least about 78° C. In some aspects, a ketone wax composition can have a kinematic viscosity of about 3.0 cSt to about 6.5 cSt and a melting point of at least about 78° C.

Further Oligomerized Products and Properties

In some aspects, a ketone wax composition as described above can be exposed to conditions suitable for further oligomerization based on coupling of olefin linkages in the carbon chains in the presence of an acidic catalyst. This can result in formation of larger oligomers that can be subsequently hydroprocessed under conditions suitable for deoxygenation. Optionally, the hydroprocessing can correspond to isomerization conditions. In some aspects, the further oligomerization in the presence of an acidic catalyst can occur in the same reaction environment as the coupling in the presence of a basic catalyst, or the oligomerization in the presence of an acidic catalyst can occur prior to coupling in the presence of a basic catalyst.

The resulting oligomers formed by olefin coupling in the presence of an acidic catalyst can have a broad distribution of olefins, as represented by double bond equivalents (DBEs) in the oligomer product. DBE values can be obtained by characterizing a product using field desorption time of flight (FD-TOF) mass spectrometry. In particular, the broad distribution of olefins in the resulting oligomer product can be broad within each carbon number represented in the product. In other words, for the compounds in the oligomer product, a variety of different double bond equivalent amounts can be present for the compounds corresponding to each carbon number present in the oligomer product.

In aspects where sequential processing is used to form oligomers from a ketone wax composition, the DBE values can be characterized for compounds with carbon numbers larger than 20. For such compounds, the percentage of molecules with a DBE value of 6 can be 30% or less of the total intensity detected using FD-TOF for each carbon chain length. Additionally or alternately, the percentage of molecules with a DBE value of 5 can be 20% or less of the total intensity for each carbon chain length. Additionally or alternately, the percentage of molecules with a DBE value of 4 can be 20% or less of the total intensity for each carbon chain length.

In aspects where both an acidic and a basic catalyst are present in the same environment, so that oligomerized ketones can be formed in a single processing step, the DBE values can be characterized for compounds with carbon numbers larger than 20. For such compounds, the percentage of molecules with a DBE value of 6 can be 45% or less of the total intensity detected using FD-TOF for a given carbon chain length. Additionally or alternately, the percentage of molecules with a DBE value of 5 can be 20% or less of the total intensity for a given carbon number. Additionally or alternately, the percentage of molecules with a DBE value of 4 can be 20% or less of the total intensity for a given carbon number.

One example of an oligomerized product use can be as a (supplemental) feed for lubricant base oil production. For example, a vacuum gas oil feed may have low suitability for production of lubricant base oils, due to a relatively low content of paraffins in the vacuum gas oil feed. A relatively low content of paraffins can correspond to a paraffin content of about 15 wt % or less, or about 10 wt % or less. An oligomerized product as described herein can be added to a vacuum gas oil to increase the paraffin content to a more suitable level for lubricant production. In this type of scenario, adding an oligomerized product to a challenged vacuum gas oil feed can allow the high value molecules in the vacuum gas oil feed to be recovered as a lubricant base oil, as opposed to simply converting the challenged feed to fuels.

Additionally or alternately, feeds having a low content of paraffins can pose difficulties when attempting to produce a desirable yield of basestocks with sufficient viscosity index to qualify as Group III lubricant basestocks (VI of at least about 120) via a process flow including hydrocracking. A desirable yield of Group III lubricant basestock can correspond to a yield of about 10 wt % to about 50 wt % of Group III basestock relative to the weight of the feed entering a lubricant hydrocracking process. A feed with a low content of paraffins for attempting to produce Group III lubricant basestocks can correspond to a feed that, prior to hydrocracking, can comprise about 60 wt % or less of paraffins, or about 30 wt % or less, or about 20 wt % or less. For example, for a feed with a VI of about 40 or less prior to hydrocracking, a paraffin content of about 50 wt % or less can correspond to a feed with a low content of paraffins. As another example, for a feed with a VI of about 92 or less prior to hydrocracking, a paraffin content of about 25 wt % or less can correspond to a feed with a low content of paraffins. If production of a desirable yield of Group III basestock is desired, a feed with a low content of paraffins can be blended with a ketone wax composition to form a mixed feed. The resulting mixed feed can include about 5 wt % to about 50 wt % of ketone wax composition, or about 10 wt % to about 40 wt %. The mixed feed can be suitable for use in a lubricant basestock production process including hydrocracking, catalytic dewaxing, and hydrofinishing, to produce a hydrofinished effluent comprising a yield of at least about 10 wt % of Group III basestock relative to the weight of the mixed feed, or at least about 20 wt %, or at least about 30 wt %. A hydrofinished effluent can be defined to comprise an amount of Group III basestock if the hydrofinished effluent can be fractionated to form the amount of Group III basestock based on typical fractionation conditions.

Conversion of Fatty Acids and Fatty Acid Derivatives to Ketone-Containing Product An initial step in forming a ketone wax (or other long chain ketone) can be to perform a coupling reaction to convert two shorter carbon chains into a ketone having a longer carbon chain. A catalyst suitable for facilitating a coupling or conversion reaction to form ketones from carboxylic acids and/or carboxylic acid derivatives (such as amides, including substituted amides, or glycerides, including triglycerides) can comprise or be a catalyst including a rare earth metal, such as a metal salt of a rare earth metal, an alkali metal, an alkaline earth metal, or a combination thereof. Some suitable catalysts can include clay materials containing a rare earth metal, an alkali metal, and/or an alkaline earth metal. For example, hydrotalcite is a clay including magnesium hydroxide. Additionally or alternately, some examples of suitable catalysts can include support materials impregnated with a rare earth metal salt, an alkali metal salt, and/or an alkaline earth metal salt, such as an oxide, hydroxide, or carbonate. For example, a refractory support such as titanium oxide, zirconium oxide, and/or cerium oxide can be impregnated with a lanthanum, sodium, and/or potassium salt, such as potassium carbonate. Additionally or alternately, some examples of suitable catalysts can include bulk and/or supported versions of rare earth, alkali, or alkaline earth metal salts, such as magnesium oxide and/or cesium oxide. More generally, alkali metal salts can include salts of Na, K, Rb, and/or Cs, while alkaline earth metal salts can include salts of Mg, Ca, Sr, and/or Ba. Rare earth metal salts can include, but are not limited to, salts of La, Ce, Nd, and/or Y. Thus, a reference herein to a rare earth metal or rare earth metal salt is defined to include at least La, Ce, Nd, and/or Y.

A suitable catalyst can include at least about 5 wt % of a rare earth metal salt, alkali metal salt, or alkaline earth metal salt relative to the total catalyst weight, or at least about 15 wt %, or at least about 25 wt %, such as up to 75 wt % or more. For catalysts based on clays, the catalyst can include about 75 wt % or less of rare earth metal salt, alkali metal salt, or alkaline earth metal salt, or about 50 wt % or less, or about 35 wt % or less, or about 25 wt % or less, such as down to about 15 wt % or less. For supported catalysts, the catalyst can include about 35 wt % or less of rare earth metal salt, alkali metal salt, or alkaline earth metal salt, or about 25 wt % or less, or about 15 wt % or less, such as down to about 5 wt % or less. In general, higher percentages of a rare earth metal salt, an alkali metal salt, or an alkaline earth metal salt can be desirable, but practical factors may limit the amount of rare earth metal salt, alkali metal salt, and/or alkaline earth metal salt. For example, supported catalysts may be limited based on the amount of salt that can be impregnated or otherwise added to a support in a manner stable in the reaction environment. Similarly, the amount of rare earth metal salt, alkali metal salt or alkaline earth metal salt present in a clay may be limited in order to form a stable clay.

Some catalysts suitable for catalyzing a coupling reaction can also be suitable for converting amides to cyanide groups via an alternative reaction pathway. For feeds including fatty amides as part of the fatty acid derivatives in the feed, a coupling catalyst including oxides of Mg, Ca, or Al can also potentially convert at least a portion of amides to cyanide groups as a competing reaction to coupling the amides to form ketones. It is noted that Mg, Ca, or Al oxides may be present as a support material for a coupling catalyst.

To convert fatty acids and/or fatty acid derivatives to ketones, a suitable feedstock can be exposed to a catalyst containing a rare earth metal, alkali metal, and/or alkaline earth metal under effective conditions for performing the conversion reaction. The effective conditions for the conversion reaction can advantageously include a temperature from about 300° C. to about 450° C. Hydrogen gas may not be required to facilitate the condensation reaction. However, in aspects where a single reactor is used both for forming ketones as well as for deoxygenation and/or isomerization of a feed, hydrogen can typically be present in order to facilitate the deoxygenation and isomerization reactions. As a result, in such embodiments, a hydrogen partial pressure of about 1.8 MPag to about 35 MPag can typically be present. In such a configuration, the reaction temperature can be from about 300° C. to about 450° C., or about 320° C. to about 360° C., in order to balance the benefits of the reactions occurring in the single reaction environment.

Exposure of (free) fatty acids and/or fatty acid derivatives (such as glycerides or amides) to a rare earth, alkali metal, and/or alkaline earth metal catalyst can tend to generate a mixture of products. One of the majority products in such a mixture can generally be a fatty ketone. It is believed that fatty ketones are formed via a reaction between carbon chains of two fatty amide, fatty acid, or fatty acid derivative molecules. By using a feed having fatty carbon chains of about 14 to about 22 carbons in length, a resulting ketone wax product can be formed having a carbon chain length of 27 to 39 carbons in length. Additionally or alternately, this ketone wax product can have unexpected properties relative to traditional waxes and/or other hydrocarbon-like mixtures having a similar average carbon chain length.

FIG. 1 shows an example of a conventional reaction mechanism for conversion of triglycerides (i.e., fatty acid derivatives) into oligomerized products. In FIG. 1, a triglyceride is shown as an initial starting molecule. Base catalyzed coupling can be used to convert the triglycerides into fatty ketones, where the length of the ketone carbon chain can roughly correspond to the combined length of the two glyceride chains coupled to form the ketone. In the example shown in FIG. 1, the triglyceride can correspond to a triglyceride including one or more olefins in the carbon chain, so that the resulting ketone can correspond to an olefinic ketone. The olefinic ketone can then be coupled under acidic coupling conditions to form an oligomerized product. In the example shown in FIG. 1, the oligomerized product can correspond to acidic coupling of two olefinic ketones. Depending on the nature of the reaction conditions and available feed, other acidic coupling reactions can lead to formation of products based on coupling of an olefinic ketone with a glyceride chain, or based on coupling of two glycerides.

For molecules other than glycerides, such as fatty amides, free fatty acids, or other fatty acid derivatives, a reaction mechanism analogous to the reaction shown in FIG. 1 can lead to formation of ketones and/or oligomerized products.

In aspects involving a feed that contains glycerides such as triglycerides, the rare earth, alkali, and/or alkaline earth catalysts according to the invention can allow for the direct conversion of triglycerides and other glycerides to fatty ketones, without requiring an initial step to form the free fatty acid. The addition of hydrogen and/or water to generate free fatty acids may also not be required. Instead, exposing a glyceride-containing feedstock to the rare earth, alkali, and/or alkaline earth metal can allow for direct conversion of glycerides to a mixture of ketones.

In aspects where a desired product is similar to a ketone wax composition, the desired product may correspond to a ketone wax composition at least partially saturated and/or at least partially deoxygenated. In such aspects, either before or after optional separation of a $C_{27}$-$C_{39}$ ketone wax composition from the remaining portion of a reaction effluent, the ketone wax composition can be exposed to a hydroprocessing catalyst. Depending on the nature of the hydroprocessing catalyst and the hydroprocessing conditions, this can allow for removal of heteroatoms (including but not limited to the oxygen of the ketone group), saturation of olefins, and/or isomerization of the ketone wax/paraffins generated by deoxygenation. During partial deoxygenation, a portion of the ketones in a ketone wax composition can be converted to other types of oxygenates, such as alcohols. It can be noted that removal of the ketone oxygen does not involve breaking a bond within the main carbon chain, so deoxygenation of the ketone wax need not result in a substantial loss of carbon chain length. Examples of metals for hydrogenation catalysts can include, but are not limited to, supported or bulk Ni, Pt, Pd, Ru, Rh, Co, Co—Mo, and Ni—Mo, as well as their sulfides. The support can be silica, alumina, titania, zirconia, carbon, and clay.

For a feedstock including a sufficient number of fatty acids and/or fatty acid derivatives, it can be desirable to select a catalyst for catalyzing the conversion reaction that can remain relatively stable in the reaction environment if water is present. The conversion of fatty acids and/or free fatty acid derivatives to ketones using a rare earth, alkali, and/or alkaline earth metal catalyst can result in some production of water, so catalysts that deteriorate in water may pose some difficulties in scaling up a process for commercial use. For example, the clay hydrotalcite can be effective for catalyzing the reactions described herein. However, hydrotalcite can break down over time in the conditions for converting triglycerides to ketones. Without being bound by any particular theory, this may due to a phase change of the hydrotalcite alumina, such as a phase change induced by the presence of water under the conditions present in the conversion processing environment. Some phases of alumina, such as γ-alumina, are believed to be unstable in processing environments including a sufficient amount of water under sufficiently severe pressure and/or temperature conditions, leading to phase changes for supports composed of such types of alumina that can result in a loss of activity over time. A further possible explanation is the leaching of magnesium from the hydrotalcite, resulting in formation of Mg soaps in combination with free fatty acids. An example of a catalyst suitable for coupling of fatty acids and/or fatty acid derivatives to ketones that can also be resistant to degradation due to the presence of water can include, but is not limited to, lanthanum impregnated zirconia.

Olefin Oligomerization and Conversion of Ketone to Alcohol for Further Condensation The ketone wax product described above can be considered as formation of ketone "dimers" from two fatty acid/fatty acid derivative (such as a fatty alcohol, fatty amide, glyceride, or other fatty acid ester) chains. In some aspects, it can be desirable to form still larger oligomers, such as trimers, tetramers, or pentamers. One option for forming larger oligomers can be to start with ketone wax composition formed as described above, and then perform further oligomerization using an acidic catalyst. In some aspects, exposure of feedstock(s) to acidic and/or basic catalysts can be performed in any convenient order, including exposure to both acidic and basic catalysts in the same reaction environment or sequential exposure, to form larger oligomers. The larger oligomers can also correspond to oxygenated oligomers not including an oxygen linkage in the primary carbon chain. As a result, the larger oligomers can be subsequently hydroprocessed to at least partially remove oxygen heteroatoms while maintaining carbon chain length.

In some aspects, a fatty ketone feed formed according to the methods described above, optionally after separation to form a separated product having an increased concentration of fatty ketones (i.e., separate fatty ketones from other reaction products), can be further oligomerized in the presence of an acidic catalyst. In such aspects, the fatty ketone feed can correspond to an at least partially unsaturated fatty ketone feed. In some aspects, a fatty ketone feed can be further oligomerized in the presence of a basic catalyst and in the presence of additional fatty acids/fatty acid derivatives (such as a fatty alcohol, glyceride, or other fatty acid ester). For example, a fatty ketone can be converted to a fatty alcohol, and then can be exposed to conditions suitable for a condensation reaction (such as esterification) with other fatty acids and/or fatty acid derivatives.

Acidic and Basic Catalysts—Definition

Exposure of a feedstock to a basic catalyst under coupling (oligomerization) conditions is described above. More generally, oligomerization can be performed in the presence of either basic or acidic catalysts, or even in a reaction environment including both at least one basic and at least one acidic catalyst.

Catalysts having sufficient acidic or basic properties to be effective in coupling fatty acids, fatty acid esters, fatty alcohols, fatty olefins, or glycerides (mono-, di-, or triglycerides) can be identified by determining the molar ratio of chemisorption of $CO_2$ and $NH_3$ over these materials. $CO_2$, a weak acid, can be used to titrate the basic sites present on the catalysts. Likewise, $NH_3$, a strong base, can be titrated to indicate the acidic sites on these materials. Many factors can determine the actual amount of chemisorption, such as surface area of the material (often significantly affected by the catalyst preparation method), the measurement temperature for chemisorption, and the testing pressure for chemisorption. The ratio of adsorbed $CO_2$ and $NH_3$ can indicate a relative acidity or basicity.

In this discussion, a "basic" catalyst can be defined as material having a molar ratio of chemisorption of $CO_2$ per gram of material to the chemisorption of $NH_3$ per gram of material greater than about 0.5, or greater than about 0.75, or greater than about 1.0, when tested as described below. In non-limiting examples, the "carbon dioxide/ammonia ratio" can range from about 1.0 to about 100, particularly from about 1.0 to about 50 or from about 1.0 to about 40.

An "acidic" catalyst can be defined as catalyst having a carbon dioxide/ammonia ratio of less than about 0.5, or less than about 0.3, or less than about 0.2, when tested as described below. In various embodiments, the values can range from about 0.05 to about 0.5, particularly from about 0.05 to about 0.3 or from about 0.05 to about 0.2.

Determination of carbon dioxide/ammonia ratio (i.e. the molar ratio of chemisorption of $CO_2$ per gram of catalyst to the chemisorption of $NH_3$ per gram of catalyst) can be conducted using a Mettler™ TGA/SDTA 851 thermogravimetric analysis system at ambient pressure. The catalyst sample can be calcined in flowing air at ~500° C. for three hours or at least until a constant sample weight is obtained. The temperature of the sample can then be reduced in flowing air (helium could also be used) to the desired temperature of chemisorption. Next, the sample can be allowed to equilibrate at the desired temperature in flowing helium and weighed. Chemisorption of carbon dioxide can be measured at ~150° C., and chemisorption of ammonia can be measured at ~250° C. After being weighed, the sample can be subjected to a number of pulses (~12 seconds/pulse) of gaseous mixture containing helium and either carbon dioxide or ammonia until a constant weight can be obtained. The gas mixture can contain ~10 mol % carbon dioxide or ammonia, with the remainder being helium. After each pulse of the gas mixture being tested, the sample can be flushed with flowing helium for ~3 minutes. About 20 separate pulses of the gas mixture can be used in each test. The increase in weight of the sample in terms of mg/g material based on the sample weight after calcination can be used to determine the moles of $CO_2$ or $NH_3$ adsorbed per gram of material.

Molar ratios of chemisorption of $CO_2$ to the chemisorption of $NH_3$ per gram of material for some representative catalysts are shown in Table 1.

TABLE 1

| Materials | $CO_2/NH_3$ Chemisorption Molar Ratio |
|---|---|
| MgO (Elastomag ™ 170) | ~7.82 |
| MgO (MagChem ™m 200AD) | ~6.92 |
| $\gamma$-$Al_2O_3$ (Alfa ™ # 43832) | ~0.47 |
| Hydrotalcite (Pural ™ MG30) | ~1.35 |
| Hydrotalcite (Pural ™ MG63) | ~1.95 |
| Hydrotalcite (Pural ™ MG70) | ~2.30 |
| $W/ZrO_2$ | ~0.07 |
| $La_2O_3$ | ~6.64 |
| $La/SiO_2$ | ~0.92 |
| $AlPO_x$ | ~0.75 |
| $NdAlPO_x$ | ~1.04 |
| $YAlPO_x$ | ~0.86 |
| $PrAlPO_x$ | ~1.05 |
| $La/ZrO_2$ (~700° C. calcined) | ~1.06 |
| $Y_2O_3$-~5% $ZrO_2$ | ~6.17 |
| $Y_2O_3$-~25% $ZrO_2$ | ~1.18 |
| $Nd_2O_3$ | ~35.37 |
| $Sm_2O_3$ | ~15.61 |
| $Y_2O_3$ | ~14.95 |
| $CeO_2$ | ~8.48 |
| $Pr_2O_3$ | ~1.56 |
| $TiO_2$ | ~0.55 |
| $ZrO_2$ | ~0.33 |

TABLE 1-continued

| Materials | $CO_2/NH_3$ Chemisorption Molar Ratio |
|---|---|
| SAPO-34 | ~0.19 |
| ZSM-5 | ~0.16 |
| $SiO_2$ | ~0.02 |
| USY | ~0.00 |
| ~75/~25 $SiO_2/Al_2O_3$ | ~0.38 |
| ~50/~50 $SiO_2/Al_2O_3$ | ~0.47 |
| 25/25 $SiO_2/Al_2O_3$ | ~0.41 |
| 13/87 $SiO_2/Al_2O_3$ | ~0.42 |
| $La_2O_3/SiO_2$ | ~0.92 |
| MCM-41 | ~0.44 |

Catalysts suitable for coupling fatty acids, fatty amides, fatty acid esters, fatty alcohols, fatty olefins, glycerides (mono-, di-, or tri-glycerides), or other fatty acid derivatives can be drawn from oxides and mixed oxides of metals of Group 1 to Group 6, Group 12 to Group 15, Lanthanide Series, or Actinide Series of the Periodic Table of Elements. The catalysts can also comprise acidic or basic clays such as hydrotalcites, bentonite, montmorillonite, aluminosilicates such as zeolites, aluminophosphates, or metalloaluminophosphates (where metal comprises or is, for example, Si, Nd, Y, Pr, Ce, Ti, or Zr).

In some aspects, the coupling catalysts can comprise two or more metal oxides, particularly one Group 4 metal oxide and one or more selected from Group 2, Group 3, Lanthanide Series, and Actinide Series metal oxides. In some aspects, the coupling catalysts can be selected from oxides of Group 2, Group 12, or Group 13 elements, and mixtures thereof. In some aspects, the coupling catalysts can be either naturally occurring or synthetic clays such as hydrotalcite, bentonite, montmorillonite, or mixtures thereof. Compositions for each individual component in the oxide mixtures can vary within the range of ~1-99%. The oxides can be prepared using a variety of methods, although generally they are prepared by converting a suitable precursor by precipitation from solution and/or calcination. Suitable precursors can include metal salts, such as halides, sulfates, phosphates, halides, nitrates, hydroxides, oxychlorides, alkoxides, and acetates.

In some embodiments, a metal oxide useful as a catalyst can be produced by first preparing a liquid solution comprising a salt of the metal in a solvent, such as water. The resultant solution can then be subjected to conditions sufficient to cause precipitation of the solid oxide material, such as by the addition of a precipitating reagent, typically a base such as sodium hydroxide or ammonium hydroxide. The liquid solution can be generally maintained at a temperature at or below 200° C. during the precipitation, for example in the range of from 0° C. to 200° C., such as from 20° C. to 100° C. In an embodiment, the resulting gel can be hydrothermally treated at a temperature of at least 80° C., particularly at least 100° C., for up to 10 days, such as up to 5 days, for example up to 3 days. The resulting material can then be recovered, for example by filtration or centrifugation, washed, and dried. The resulting particulate material typically can then be calcined, normally in an oxidizing atmosphere, at a temperature of at least 400° C., such as from 400° C. to 800° C., for up to 48 hours, such as for 0.5 hours to 24 hours, for example for 1 hour to 10 hours.

When two or more metal oxides are used for the coupling of fatty acids, fatty acid esters, fatty alcohols, fatty olefins, or glycerides (mono-, di-, or tri-glycerides), they may either be co-precipitated or precipitated separately and combined with each other at any later stage of processing including as calcined solid particles.

Acidic Catalysts

In addition to or as an alternative to coupling in the presence of a basic catalyst as described above, fatty acid and/or fatty acid derivative coupling can be catalyzed by a catalyst component having adequate acidity to catalyze the conversion chemistry. According to the definitions used herein, acidic catalysts can correspond to a class of materials with the "carbon dioxide/ammonia ratio" in the range of 0.05 to 0.5, particularly from 0.05 to 0.3 or from 0.05 to 0.2.

Although acidic catalysts can perform other functions, acidic catalysts can be suitable for catalyzing the reaction of unsaturated fatty acids to make dimers and higher oligomers of fatty acids. For this reason, the acidic catalysts can be referred to as oligomerization catalysts. Oligomerization reactions can be carried out with suitable catalysts at high temperature. Suitable catalysts can include molecular sieves (both aluminosilicate zeolites and silicoaluminophosphates), metalloaluminophosphates, amorphous aluminosilicates, cationic acidic clays, and other solid acid catalysts or mixtures thereof. Examples of acid catalysts can include but are not limited to large pore zeolites (e.g., Faujasite, Beta, MWW family, etc.), medium (10-ring) to small (8-ring) pore zeolites (e.g., MFI, CHA, MOR, etc.) with small particle sizes, acidic mixed metal oxides ($WO_x/ZrO_2$, $MoO_x/ZrO_2$), alumina, silica-alumina, and acidic clays, or mixtures thereof.

More generally, examples of the molecular sieves can be of the large (>12-ring pore opening), medium (10-ring opening) or small (<8-ring pore opening) pore type. The molecular sieves structure types can be defined using three letter codes. Non-limiting examples of small pore molecular sieves can include AEI, AFT, ANA, APC, ATN, ATT, ATV, AWW, BIK, CAS, CHA, CHI, DAC, DDR, EDI, EM, GIS, GOO, KFI, LEV, LOV, LTA, MER, MON, PAU, PHI, RHO, ROG, SOD, THO, and substituted forms thereof. Non-limiting examples of medium pore molecular sieves can include AFO, AEL, EUO, HEU, FER, MEL, MFI, MTW, MTT, MWW, TON, and substituted forms thereof. Non-limiting examples of large pore molecular sieves can include BEA, CFI, CLO, DNO, EMT, FAU, LTL, MOR and substituted forms thereof. In one embodiment, zeolite catalysts can have a Si/Al molar ratio of greater than 2 and at least one dimension of the pore openings greater than or equal to 10-ring. Solid zeolites for some embodiments can include ZSM-5 (MFI), zeolite beta (BEA), USY family zeolites (FAU), MCM-22, MCM-49, and MCM-56 (MWW). Mesoporous materials with pore openings greater than 20 angstroms, such as the MCM-41 family and SBA-15 type with aluminum incorporated into the structure and thus possessing acidity, can also be used as oligomerization catalysts.

An additional or alternative class of acidic materials can include metalloaluminophosphates (MeAPO), where the metal (Me) can comprise silicon, transition metal elements such as Ti, Zr, Fe, Co, Ni, Cu and Zn, and/or rare-earth elements such as Y, La, Ce, Pr, Nd, Sm and Gd. Acidic clays can include acidic, natural or synthetic montmorillonites, bentonite, silica clay, alumina clay, magnesia clay, and silica-alumina clay. Commercially available acidic forms of Filtrol™ clays can also be suitable.

Other solid acid catalysts, such as acidic mixed metal oxides $WO_3/ZrO_2$ and $MoO_3/ZrO_2$, other metal oxides such as sulfated zirconia, $SiO_2/ZrO_2$, $Al_2O_3/ZrO_2$, $MgO/SiO_2$, and Nafions™ or other acidic ion-exchanged resins such as Dowex™ and Amberlyst™ cation exchanged resin can also be suitable for the oligomerization reaction.

The acid catalyzed coupling reactions can be carried out at suitable temperatures, for example about 150° C. to about 400° C., about 200° C. to about 400° C., or about 250° C. to about 350° C. A liquid hourly space velocity of from about 0.1 to about 10 v/v/h, particularly about 0.5 to about 5 v/v/h, can be applied. Hydrogen gas may not be required to facilitate the condensation reaction. However, in embodiments involving a single reactor used for both the acid catalyst and a hydrogenation catalyst, hydrogen can be present in order to facilitate the hydrogenation reaction. As a result, a hydrogen partial pressure of about 1.8 MPag to about 35 MPag can be present in some aspects. The presence of hydrogen may reduce the cyclic oligomer formation. This is beneficial for production of high paraffinic hydrocarbons at the end of the conversion.

Fatty Acid (Derivative) Feeds

Regardless of the initial source, feeds usable in the present invention can include any of those which comprise (free) fatty acids, fatty acid derivatives (such as fatty amides, including substituted fatty amides), or glycerides (another type of fatty acid derivative) such as triglycerides, diglycerides, monoglycerides. The fatty acids and/or fatty acid derivatives typically contain aliphatic hydrocarbon chains in their structure having from 8 to 36 carbons, for example from 10 to 26 carbons or from 14 to 22 carbons. The fatty acid/acid derivative constituents in a feed can be determined, for example, by using Gas Chromatography (GC) analysis and/or liquid chromatography-mass spectrometry (LCMS) analysis. In some aspects, a majority (i.e., greater than 50%) of the fatty amide/acid/acid derivatives can correspond to molecules with carbon chain lengths of $C_{14}$ to $C_{22}$.

In various aspects, the production of ketones and/or oligomerized products can be based on processing of fatty acids, glycerides (such as monoacylglycerides, diacylglycerides, and/or triacylglycerides), and/or other fatty acid derivatives within a feed. With regard to the content of fatty acids and fatty acid derivatives (including glycerides and fatty amides) in a feedstock, the feedstock can include at least about 10 wt % of fatty acids/acid derivatives, for example at least about 25 wt %, particularly at least about 40 wt %, at least about 60 wt %, or at least about 80 wt %. Additionally or alternatively, the feed can be composed entirely of fatty acids/acid derivatives, or the fatty acids/acid derivative content of the feed can be about 99 wt % or less, for example about 95 wt % or less, about 90 wt % or less, about 75 wt % or less, or about 50 wt % or less.

Further Processing of Ketone-Containing Product or Oligomerized Product

After forming a ketone wax product and/or oligomer product according to the methods above, the ketone wax/oligomer product can be exposed to a hydroprocessing catalyst for (partial) heteroatom removal, (partial) olefin saturation, catalytic dewaxing (particularly isomerization), or a combination thereof. In some aspects, the hydroprocessing catalyst can be a hydrotreatment catalyst. In some aspects, the hydroprocessing catalyst can be a catalyst such as a dewaxing catalyst also suitable for isomerizing the resulting deoxygenated molecules.

When exposing a ketone wax product to hydroprocessing conditions, it can be desirable in some aspects to select the hydroprocessing conditions to produce a hydroprocessed product that can be only partially deoxygenated. This can allow the hydroprocessed product to retain at least some of the unexpected properties of the ketone wax product. For example, after hydroprocessing of a ketone wax product, about 30 wt % to about 100 wt % of the compounds having 27 carbons to 39 carbons (or 30 carbons to 39 carbons) in the hydroprocessed product can correspond to oxygenates (such as ketones), or about 40 wt % to about 90 wt %, or about 50 wt % to about 80 wt %. Similarly, it can be desirable to select hydroprocessing conditions that allow the hydroprocessed product to retain at least a portion of the olefins present in ketone wax product. For example, about 20 wt % to about 90 wt % of the compounds having 27 carbons to 39 carbons (or 30 carbons to 39 carbons) can correspond to olefins, or about 40 wt % to about 80 wt %, or about 50 wt % to about 75 wt %.

In some embodiments, an additional consideration in selecting a hydroprocessing catalyst can be that the catalyst should be relatively stable in the presence of water, due to the potential generation of water during conversion of fatty acids or triglycerides to ketones. This would allow for the ketone-containing product from the conversion step to be hydroprocessed without the requirement for prior water removal. Further, it can allow for a step-skipping process where the fatty amide, fatty acids, and/or fatty acid derivatives (including glycerides) in the feed are directly converted to the heteroatom-free product over a stacked bed of catalyst.

In some embodiments, an intermediate separation can be used between the coupling reaction and the deoxygenation reaction in order to remove gas phase contaminants. The intermediate separation allows for removal of $NH_3$, $H_2O$, and/or CO that can form in the reaction environment for the coupling reaction. Other gas phase contaminants (such as $CO_2$) having a lower tendency to cause catalyst poisoning or to otherwise inhibit catalyst activity can also be removed.

Suitable catalysts for performing deoxygenation and isomerization can include dewaxing catalysts, such as zeolites. Optionally, the dewaxing catalyst can be bound using a binder material that can be stable in the presence of water under effective deoxygenation and/or isomerization conditions. Such a binder material is referred to herein as a hydrothermally stable binder. Examples of suitable dewaxing catalysts can include zeolites that perform dewaxing primarily by isomerizing a hydrocarbon feedstock. Optionally, the dewaxing catalysts can be zeolites with a unidimensional pore structure. Suitable catalysts can include 10-member ring pore zeolites, such as EU-1, ZSM-35 (or ferrierite), ZSM-11, ZSM-57, NU-87, SAPO-11, ZSM-22, and the like, and combinations thereof. Exemplary materials can comprise EU-2, EU-11, ZBM-30, ZSM-48, and/or ZSM-23, particularly comprising at least ZSM-48. Note that a zeolite having the ZSM-23 structure with a silica to alumina ratio from about 20:1 to about 40:1 can sometimes be referred to as SSZ-32. Additional or alternative molecular sieves isostructural with the above materials can include, but are not limited to, Theta-1, NU-10, EU-13, KZ-1, NU-23, and combinations thereof.

The catalysts can optionally but preferably include a metal hydrogenation component. The metal hydrogenation component can typically include a Group VI and/or a Group VIII metal. In one preferred embodiment, the metal hydrogenation component can be a Group VIII noble metal, such as Pt, Pd, or a mixture thereof. In an alternative preferred embodiment, the metal hydrogenation component can be a combination of a non-noble Group VIII metal with a Group VIB metal. Suitable combinations can include Ni, Co, and/or Fe with Mo and/or W, particularly Ni with Mo and/or W.

The metal hydrogenation component may be added to the catalyst in any convenient manner. One technique for adding the metal hydrogenation component can be incipient wetness. For example, after combining a zeolite and a hydrothermally stable binder, the combined zeolite and binder can be extruded into catalyst particles. These catalyst particles can then be exposed to a solution containing a suitable metal precursor. Additionally or alternately, metal can be added to the catalyst by ion exchange, where a metal precursor can be added to a mixture of zeolite (or zeolite and binder) prior to extrusion.

When a metal hydrogenation component is present, the amount of metal in the catalyst can be at least 0.1 wt % based on catalyst, for example at least 0.15 wt %, at least 0.2 wt %, at least 0.25 wt %, at least 0.3 wt %, or at least 0.5 wt %, based on the total weight of the catalyst. Additionally or alternately, the amount of metal in the catalyst can be 20 wt % or less based on catalyst, for example 10 wt % or less, 5 wt % or less, 2.5 wt % or less, or 1 wt % or less. For embodiments where the metal comprises Pt, Pd, another Group VIII noble metal, or a combination thereof, the amount of metal can be from 0.1 wt % to 5 wt %, for example from 0.1 to 2 wt %, from 0.25 wt % to 1.8 wt %, or from 0.4 wt % to 1.5 wt %. For embodiments where the metal comprises a combination of a non-noble Group VIII metal with a Group VIB metal, the combined amount of metal can be from 0.5 wt % to 20 wt %, for example from 1 wt % to 15 wt % or from 2.5 wt % to 10 wt %.

In certain advantageous embodiments, the dewaxing catalysts can exhibit a low silica to alumina ratio. For example, for ZSM-48, the ratio of silica to alumina in the zeolite can be less than 200:1, for example less than 150:1, less than 130:1, less than 110:1, less than 100:1, less than 90:1, or less than 80:1. In particular, the ratio of silica to alumina can be from 30:1 to 200:1, or from 40:1 to 110:1 or from 60:1 to 100:1.

The dewaxing catalysts can include a hydrothermally stable binder. Examples of suitable hydrothermally stable binders can include metal oxides such as titanium oxides, zirconium oxides, cerium oxides, and combinations thereof. By contrast, aluminum oxides are not believed to be typically suitable for use as binders in reaction environments that contain water. Preferably, the catalyst for deoxygenation and isomerization can include a binder material that can provide enhanced activity for deoxygenation, such as a titania binder. In environments where stability in the presence of water is not required, other suitable types of binders can be used, including alumina or silica-alumina binders.

Optionally, the dewaxing catalysts can be formulated using a relatively low surface area binder, a relatively low surface area binder representing a binder with a surface area of 100 $m^2/g$ or less, for example 80 $m^2/g$ or less or 70 $m^2/g$ or less. Additionally or alternately, the binder and/or the zeolite particle size can be selected to provide a catalyst with a desired ratio of micropore surface area to total surface area. The micropore surface area can correspond to surface area from the unidimensional pores of zeolites in the dewaxing catalyst. The total surface area can correspond to the micropore surface area plus the external surface area. Any binder used in the catalyst will typically not contribute much to the micropore surface area and typically will not significantly increase the total surface area of the catalyst. The external surface area represents the balance of the surface area of the total catalyst minus the micropore surface area. Both the binder and zeolite can contribute to the value of the external surface area. In some preferred embodiments, the ratio of micropore surface area to total surface area for a dewaxing catalyst can be equal to or greater than 25%.

A zeolite can be combined with binder in any convenient manner. For example, a bound catalyst can be produced by starting with powders of both the zeolite and binder, combining and mulling the powders with added water to form a mixture, and then extruding the mixture to produce a bound catalyst of a desired size. Extrusion aids can optionally be used to modify the extrusion flow properties of the zeolite and binder mixture.

In some aspects, a binder composed of two or more metal oxides can be used. In such aspects, the weight percentage of the low surface area binder can preferably be greater than the weight percentage of the higher surface area binder. In some aspects, if both metal oxides used for forming a mixed metal oxide binder have a sufficiently low surface area, the proportions of each metal oxide in the binder can be less important. When two or more metal oxides are used to form a binder, the two metal oxides can be incorporated into the catalyst by any convenient method. For example, one binder can be mixed with the zeolite during formation of the zeolite powder, such as during spray drying. The spray dried zeolite/binder powder can then be mixed with the second metal oxide binder prior to extrusion.

Process conditions for catalytic dewaxing can include at least one of: a temperature from ~200° C. to ~450° C., for example from ~270° C. to ~400° C.; a hydrogen partial pressure from ~1.7 MPag (~250 psig) to ~35 MPag (~5000 psig), for example from ~4.8 MPag (~700 psig) to ~21 MPag (~3000 psig); a liquid hourly space velocity (LHSV) from ~0.2 v/v/hr to ~10 v/v/hr, for example from ~0.5 v/v/hr to ~3.0 v/v/hr; and a hydrogen circulation rate from ~34 $Nm^3/m^3$ (~200 SCF/bbl) to ~1700 $Nm^3/m^3$ (~10,000 SCF/bbl), for example from ~170 $Nm^3/m^3$ (~1000 SCF/bbl) to ~850 $Nm^3/m^3$ (~5000 SCF/bbl).

In some alternative aspects, other types of hydroprocessing catalysts and reactions can be used for removing any remaining heteroatoms from the conversion reaction effluent. For example, the effluent from the conversion reaction can be exposed to a hydrotreating catalyst under effective hydrodeoxygenation and/or effective hydrotreating conditions to remove heteroatoms.

Hydrotreatment is typically used to reduce the sulfur, nitrogen, and/or aromatic content of a feed. The catalysts used for hydrotreatment can include conventional hydrotreatment catalysts, such as those that comprise at least one Group VIII non-noble metal (Columns 8-10 of IUPAC periodic table), preferably Fe, Co, and/or Ni, such as Co and/or Ni; and at least one Group VI metal (Column 6 of IUPAC periodic table), preferably Mo and/or W. Such hydrotreatment catalysts can optionally include transition metal sulfides impregnated and/or dispersed on a refractory support or carrier such as alumina and/or silica. Substantially carrier- or support-free catalysts, commonly referred to as bulk catalysts, generally have higher volumetric activities than their supported counterparts.

The catalysts can either be in bulk form or in supported form. In addition to alumina and/or silica, other suitable support/carrier materials can include, but are not limited to, zirconia, titania, zirconia-alumina, silica-zirconia, silica-titania, and titania-alumina. Suitable aluminas are porous aluminas such as gamma or eta having average pore sizes from ~50 to ~200 Å, or ~75 to ~150 Å; a surface area from ~100 to ~300 $m^2/g$, or ~150 to ~250 $m^2/g$; and a pore volume of from ~0.25 to ~1.0 $cm^3/g$, or ~0.35 to ~0.80 $cm^3/g$. In aspects where the amount of water present in the hydrotreatment environment is of concern, supports that do not contain alumina can be preferred. More generally, any convenient size, shape, and/or pore size distribution for a catalyst suitable for hydrotreatment of a distillate (including lubricant base oil) boiling range feed in a conventional manner may be used. It is within the scope of the present invention that more than one type of hydroprocessing catalyst can be used in one or multiple reaction vessels.

The at least one Group VIII non-noble metal, in oxide form, can typically be present in an amount ranging from about 2 wt % to about 30 wt %, preferably from about 4 wt % to about 15 wt %. The at least one Group VI metal, in oxide form, can typically be present in an amount ranging from about 2 wt % to about 60 wt %, preferably from about 6 wt % to about 40 wt % or from about 10 wt % to about 30 wt %. These weight percents are based on the total weight of the catalyst. Suitable metal catalysts can include cobalt/molybdenum (~1-10% Co as oxide, ~10-40% Mo as oxide), nickel/molybdenum (~1-10% Ni as oxide, ~10-40% Co as oxide), or nickel/tungsten (~1-10% Ni as oxide, ~10-40% W as oxide), e.g., supported on alumina, silica, silica-alumina, or titania.

The hydrotreatment can be carried out in the presence of hydrogen. A hydrogen stream can, therefore, be fed or injected into a vessel or reaction zone or hydroprocessing zone in which the hydroprocessing catalyst is located. Hydrogen, contained in a hydrogen "treat gas," can be provided to the reaction zone. Treat gas, as referred to in this invention, can be either pure hydrogen or a hydrogen-containing gas, which is a gas stream containing hydrogen in an amount sufficient for the intended reaction(s), optionally including one or more other gases (e.g., nitrogen and light hydrocarbons such as methane), and which should not adversely interfere with or adversely affect either the reactions or the products. Impurities, such as $H_2S$ and $NH_3$ can be generally undesirable and can typically be removed from the treat gas before being conducted to the reactor. The treat gas stream introduced into a reaction stage can contain at least about 50 vol %, e.g., at least about 75 vol %, hydrogen.

In some aspects, hydrogen can be supplied at a rate of about 100 SCF/bbl (standard cubic feet of hydrogen per barrel of feed) (~17 $Nm^3/m^3$) to about 1500 SCF/bbl (~250 $Nm^3/m^3$), or about ~200 SCF/bbl (~34 $Nm^3/m^3$) to about ~1200 SCF/bbl (~200 $Nm^3/m^3$). In such aspects, a reduced amount of hydrogen can be supplied to reduce or minimize olefin saturation. In some aspects, hydrogen can be supplied at a rate of ~200 SCF/bbl (~34 $Nm^3/m^3$) to ~10000 SCF/bbl (~1700 $Nm^3/m^3$), or ~500 SCF/bbl (~85 $Nm^3/m^3$) to ~10000 SCF/bbl (~1700 $Nm^3/m^3$). Hydrogen can be supplied co-currently with the input feed to the hydrotreatment reactor and/or reaction zone or separately via a separate gas conduit to the hydrotreatment zone.

Hydrotreating conditions can include temperatures of ~200° C. to ~450° C., or ~315° C. to ~425° C.; pressures of ~250 psig (~1.8 MPag) to 5000 psig (~35 MPag) or ~300 psig (~2.1 MPag) to ~3000 psig (~21 MPag); and liquid hourly space velocities (LHSV) of ~0.1 $hr^{-1}$ to ~10 $hr^{-1}$. Alternatively, hydrotreating conditions can be similar to the effective dewaxing conditions described above.

There can be several alternatives for how to incorporate a dewaxing catalyst and/or hydrotreating catalysts into the reaction system. One option can be to have the acidic and/or basic catalyst in a first catalyst bed or beds (for dimerization/oligomerization) and the dewaxing (and/or other hydroprocessing) catalyst(s) in a second bed or beds. An intermediate separation can be performed between the first bed(s) and second bed(s) to remove gas phase contaminants generated from reaction with the catalyst in the first catalyst bed(s). The intermediate separation allows $NH_3$ and $H_2O$ generated from reaction with the rare earth, alkali, and/or alkaline earth metal catalyst to be removed, so that the dewaxing (and/or other hydroprocessing) catalyst can avoid exposure to these potential contaminants. The intermediate separation can be, for example, a gas-liquid separation.

In some aspects, a first reactor can contain the acidic and/or basic catalyst (for dimerization/oligomerization). The effluent from the first reactor can then be passed into one or more gas-liquid separators. The liquid effluent from the gas-liquid separator(s) can then be passed into a second reactor containing the dewaxing and/or other hydroprocessing catalyst(s). In some aspects, a single reactor can be used. A feed for processing can first be exposed to one or more catalyst beds containing acidic and/or basic catalysts (for dimerization/oligomerization). A gas-liquid separation can then be performed using a separator tray or another type of reactor internal for performing a gas-liquid separation. The liquid portion of the effluent from the first catalyst bed(s) can then be exposed to the dewaxing and/or hydroprocessing catalyst(s).

In some aspects, the acidic and/or basic catalyst and the dewaxing (and/or other hydroprocessing) catalyst(s) can be configured as stacked beds. For example, in this type of configuration, a reactor or reaction system can contain one or more initial beds of a basic catalyst for converting triglycerides and/or other fatty acids and/or fatty acid derivatives to ketones. As described above, exposing a glyceride-containing feed to the one or more initial beds of basic catalyst can result in production of an effluent containing ketones based on the carbon chains in the glycerides. The effluent containing ketones can then be exposed to one or more beds of a dewaxing catalyst under effective dewaxing conditions and/or hydrotreatment catalyst under effective hydrotreatment conditions. This can result in deoxygenation of the ketone-containing effluent. Additionally, if the effluent is exposed to a dewaxing catalyst, the effective dewaxing conditions can introduce branches into (can isomerize) the carbon chains of the ketones (or deoxygenated ketones). For fatty amides, fatty acids, or fatty acid derivatives with carbon chains that originally contain only carbon, hydrogen, and oxygen, the combination of forming ketones, deoxygenation, and isomerization can result in branched hydrocarbons containing one or more branches, such as methyl branches. Of course, if the carbon chains contain other types of heteroatoms, such as nitrogen and/or sulfur, other types of molecules may be generated.

Exemplary Configurations for Further Processing of Oligomerized Product

Figure 2:
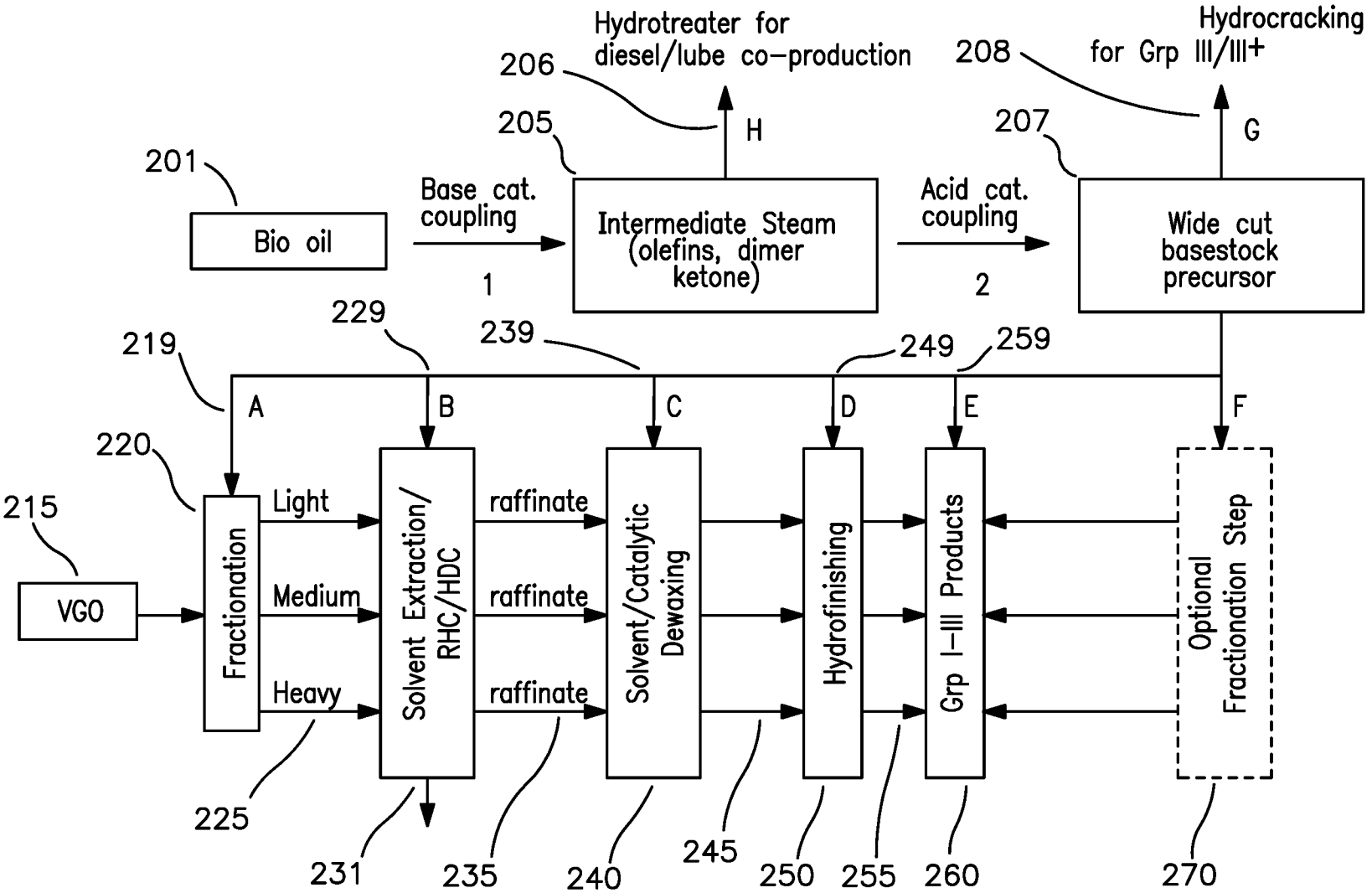
FIG. 2 shows an example of a configuration for producing lubricant boiling range products from a feedstock including an oligomerized product.

FIG. 2 shows an example of a reaction system suitable for using an oligomerized product as at least a portion of the feed for production of lubricant boiling range products. In FIG. 2, a feed 201 can include fatty acids and/or fatty acid derivatives. The feed 201 can be exposed to a basic catalyst under coupling conditions to form a coupled effluent 205 including a ketone wax product. Optionally, a portion of coupled effluent 205 can be separated out for hydrotreatment 206, such as for diesel fuel production. At least a portion of coupled effluent 205 can then be exposed to an acidic catalyst under coupling conditions to form an oligomerized product 207. The oligomerized product 207 can then be introduced into a lubricant base oil production process at one or more locations within the process. Additionally or alternately, a portion of oligomerized product 207 can be used as a feed 208 for a Group II/Group III lubricant base stock production process.

In the process train shown in FIG. 2, a vacuum gas oil feed 215 is introduced into an optional fractionator 220. A vacuum gas oil feed can correspond to a feed having a boiling range of about 600° F. (~343° C.) to about 1200° F. (~649° C.). The optional fractionator 220 can be used to separate the vacuum gas oil feed into cuts corresponding to various viscosity grades, if desired. In FIG. 2, optional fractionator 220 can separate the feed into effluent(s) 225 corresponding to light, medium, and heavy viscosity grades, which can then be processed in the various stages under conditions tuned for the separate viscosity grades, as opposed to using a general processing condition for a wide cut vacuum gas oil feed. The effluent(s) 225 from fractionator 220 (or alternatively the feed 215 if no fractionation is performed) can then be solvent extracted and/or hydrocracked 231. In a solvent processing plant, solvent extraction can be performed on the fractionated effluent(s) 225. In a catalytic processing plant, the fractionated effluent(s) can be hydrocracked. Optionally, the raffinate from solvent extraction can be hydrocracked if desired. In configurations including solvent extraction, an extract fraction can be produced. The raffinates/hydrocracked effluent(s) 235 from solvent extraction/hydrocracking 231 can then be dewaxed 240. Dewaxing 240 can correspond to solvent dewaxing or catalytic dewaxing. The dewaxed effluent(s) 245 can then be hydrofinished 250, resulting in formation of hydrofinished effluent(s) 255. Optionally, hydrofinishing 250 can be performed prior to dewaxing 240.

In FIG. 2, the oligomerized product 207 can be added to the process flow at any convenient location. Thus, the oligomerized product 207 can be added 219 to the feed prior to/during fractionation 220, can be added 229 prior to/during solvent extraction or hydrocracking 231, can be added 239 prior to/during dewaxing 240, can be added 249 prior to/during hydrofinishing 250, and/or can be added 259 to (portions of) the resulting hydrofinished effluent(s), which can correspond to lubricant boiling range products 260. Optionally, oligomerized product 207 can be fractionated 270 prior to addition to lubricant boiling range products 260. Lubricant boiling range products are defined herein as products having a boiling range of about 650° F. (~343° C.) to about 1100° F. (~593° C.), or about 650° F. (~343° C.) to about 1050° F. (~566° C.). The lubricant boiling range product(s) shown in FIG. 2 can correspond to Group I, Group II, or Group III lubricant base stocks.

Figure 3:
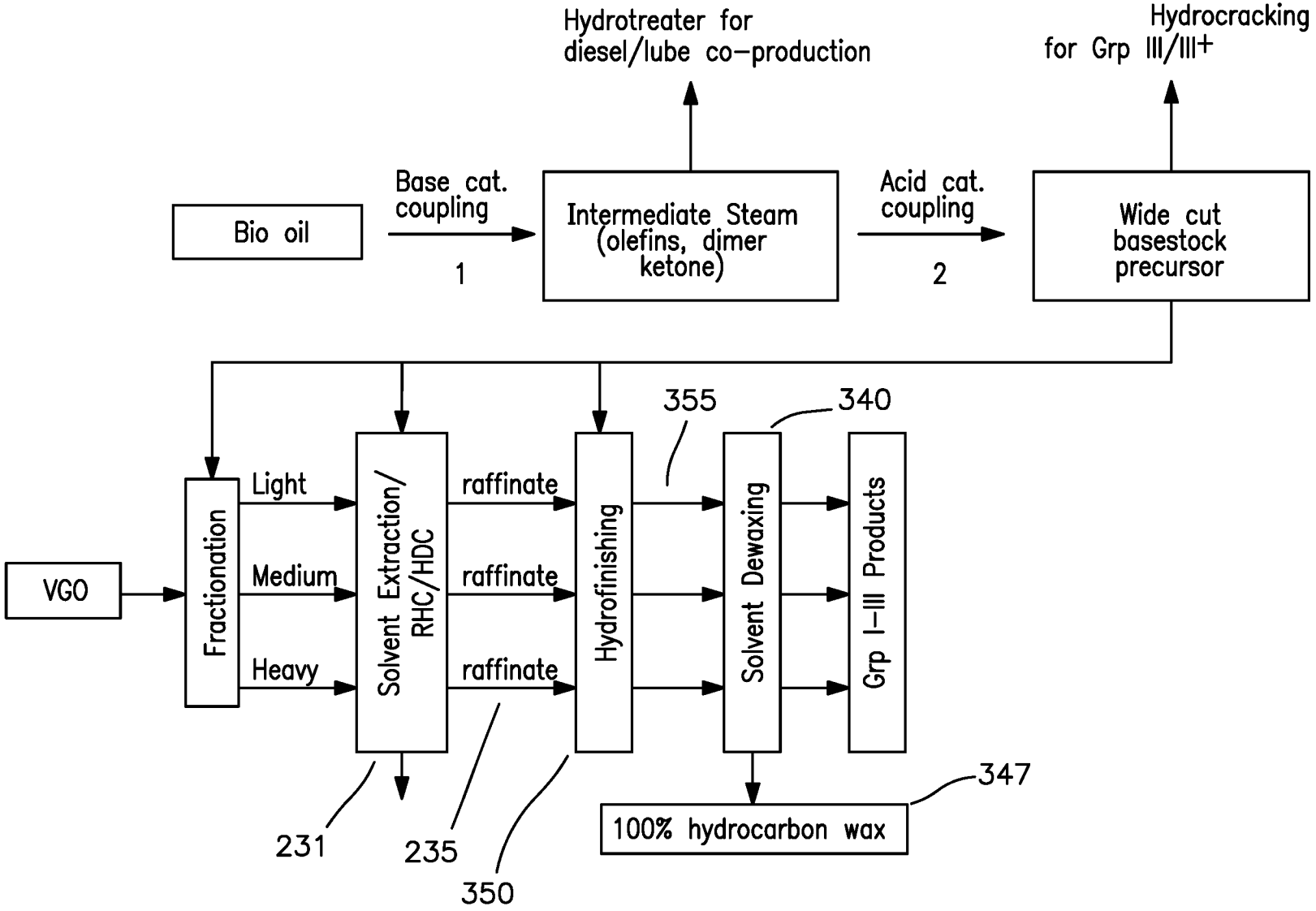
FIG. 3 shows another example of a configuration for producing lubricant boiling range products from a feedstock including an oligomerized product.

FIG. 3 shows an alternative solvent processing configuration that can allow for production of a hydrocarbon wax product. In FIG. 3, the raffinate effluent(s) 235 from solvent extraction 231 can be hydrofinished 350. The resulting hydrofinished effluent(s) 355 can then be solvent dewaxed 340. This can result in production of a wax product 347 in addition to the lubricant boiling range products corresponding to the dewaxed effluent(s) 345.

Some of the processes described in FIGS. 2-3 can correspond to solvent processing, such as solvent extraction and solvent dewaxing. Solvent extraction can be used to reduce the aromatics content and/or the amount of polar molecules. The solvent extraction process can selectively dissolve aromatic components to form an aromatics-rich extract phase while leaving the more paraffinic components in an aromatics-poor raffinate phase. Naphthenes can be distributed between the extract and raffinate phases. Typical solvents for solvent extraction can include phenol, furfural, and/or N-methyl pyrrolidone. By controlling the solvent to oil ratio, extraction temperature and method of contacting distillate to be extracted with solvent, one can control the degree of separation between the extract and raffinate phases. Any convenient type of liquid-liquid extractor can be used, such as a counter-current liquid-liquid extractor. Depending on the initial concentration of aromatics in the deasphalted oil, the raffinate phase can have an aromatics content of about 5 wt % to about 25 wt %. For typical feeds, the aromatics contents can be at least about 10 wt %.

In some aspects, the raffinate from the solvent extraction can be under-extracted. In such aspects, the extraction can be carried out under conditions such increase/maximize raffinate yield, while still removing most of the lowest quality molecules from the feed. Raffinate yield may be increased/maximized by controlling extraction conditions, for example, by lowering the solvent to oil treat ratio and/or decreasing the extraction temperature. In various aspects, the raffinate yield from solvent extraction can be at least about 25 wt %, or at least about 30 wt %, or at least about 40 wt %, or at least about 50 wt %.

Solvent dewaxing can typically involve mixing a feed with chilled dewaxing solvent to form an oil-solvent solution. Precipitated wax can thereafter be separated by, for example, filtration. The temperature and solvent can be selected so that the oil can be dissolved by the chilled solvent while the wax can be precipitated.

An example of a suitable solvent dewaxing process can involve the use of a cooling tower where solvent can be prechilled and added incrementally at several points along the height of the cooling tower. The oil-solvent mixture can be agitated during the chilling step to permit substantially instantaneous mixing of the prechilled solvent with the oil. The prechilled solvent can be added incrementally along the length of the cooling tower so as to maintain an average chilling rate at or below ~10° F. per minute, usually from ~1° F. to ~5° F. per minute. The final temperature of the oil-solvent/precipitated wax mixture in the cooling tower can usually be between ~0° F. and ~50° F. (between ~−18° C. and ~10° C.). The mixture may then be sent to a scraped surface chiller to separate precipitated wax from the mixture.

Representative dewaxing solvents can be aliphatic ketones having ~3-6 carbon atoms such as methyl ethyl ketone and methyl isobutyl ketone, low molecular weight hydrocarbons such as propane and butane, and mixtures thereof. The solvents may be mixed with other solvents such as benzene, toluene or xylene.

In general, the amount of solvent added can be sufficient to provide a liquid/solid weight ratio from ~5/1 and ~20/1 at the dewaxing temperature and a solvent/oil volume ratio between ~1.5/1 and ~5/1. The solvent dewaxed oil can typically be dewaxed to an intermediate pour point, e.g., less than about ~+10° C., such as less than about ~5° C. or less than about ~0° C.

With regard to catalytic processing, catalytic dewaxing conditions have been previously described. Hydrofinishing catalysts can include catalysts containing Group VI metals, Group VIII metals, and mixtures thereof. In some aspects, the hydrofinishing catalyst can include at least one metal sulfide having a strong hydrogenation function. In some aspects, the hydrofinishing catalyst can include a Group VIII noble metal, such as Pt, Pd, or a combination thereof. The mixture of metals may also be present as bulk metal catalysts wherein the amount of metal is about 30 wt % or greater based on catalyst. Suitable metal oxide supports can include low acidic oxides such as silica, alumina, silica-aluminas or titania. The support materials may also be modified, such as by halogenation, or in particular fluorination. The metal content of the catalyst can be as high as about 20 wt % for non-noble metals. In an embodiment, a hydrofinishing catalyst can include a crystalline material belonging to the M41S class or family of catalysts. The M41S family of catalysts are mesoporous materials having high silica content. Examples can include MCM-41, MCM-48, and MCM-50, particularly including MCM-41.

Hydrofinishing conditions can include temperatures from about 125° C. to about 425° C., e.g., about 180° C. to about 280° C., a hydrogen partial pressure from about 500 psig (~3.5 MPag) to about 3000 psig (~21 MPag), e.g., about 1500 psig (~10.3 MPag) to about 2500 psig (~17 MPag), and liquid hourly space velocity (LHSV) from about 0.1 $hr^{-1}$ to about 5 $hr^{-1}$, e.g., about 0.5 $hr^{-1}$ to about 1.5 $hr^{-1}$. Additionally, a hydrogen treat gas rate of from ~35 $Nm^3/m^3$ to 1700 $m^3/m^3$ (~200 SCF/bbl to ~10000 SCF/bbl) can be used.

Hydrocracking catalysts typically contain sulfided base metals on acidic supports, such as amorphous silica alumina, cracking zeolites such as USY, or acidified alumina. Often these acidic supports are mixed or bound with other metal oxides such as alumina, titania or silica. Examples of suitable acidic supports can include acidic molecular sieves, such as zeolites or silicoaluminophophates. One example of suitable zeolite can include or be USY, such as a USY zeolite with cell size of 24.30 Angstroms or less. Additionally or alternately, the catalyst can be a low acidity molecular sieve, such as a USY zeolite with a Si to Al ratio of at least about 20, e.g., at least about 40 or 50. ZSM-48, such as ZSM-48 with a $SiO_2$ to $Al_2O_3$ ratio of about 110 or less, such as about 90 or less, can be an additional or alternative example of a potentially suitable hydrocracking catalyst. Another additional or alternative option can be to use a combination of USY and ZSM-48. Further additional or alternative options can include using one or more of zeolite Beta, ZSM-5, ZSM-35, or ZSM-23, either alone or in combination with a USY catalyst. Non-limiting examples of metals for hydrocracking catalysts can include metals or combinations of metals including at least one Group VIII metal, such as nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can be used. Non-limiting examples of noble metal catalysts can include those based on platinum and/or palladium. Support materials useful for both the noble and non-noble metal catalysts can comprise a refractory oxide material such as alumina, silica, alumina-silica, kieselguhr, diatomaceous earth, magnesia, zirconia, or combinations thereof, with alumina, silica, alumina-silica being the most common (and preferred, in certain embodiments).

When only one hydrogenation metal is present on a hydrocracking catalyst, the amount of that hydrogenation metal can be at least about 0.1 wt % based on the total weight of the catalyst, for example at least about 0.5 wt % or at least about 0.6 wt %. Additionally or alternately when only one hydrogenation metal is present, the amount of that hydrogenation metal can be about 5.0 wt % or less based on the total weight of the catalyst, for example about 3.5 wt % or less, about 2.5 wt % or less, about 1.5 wt % or less, about 1.0 wt % or less, about 0.9 wt % or less, about 0.75 wt % or less, or about 0.6 wt % or less. Further additionally or alternately when more than one hydrogenation metal is present, the collective amount of hydrogenation metals can be at least about 0.1 wt % based on the total weight of the catalyst, for example at least about 0.25 wt %, at least about 0.5 wt %, at least about 0.6 wt %, at least about 0.75 wt %, or at least about 1 wt %. Still further additionally or alternately when more than one hydrogenation metal is present, the collective amount of hydrogenation metals can be about 35 wt % or less based on the total weight of the catalyst, for example about 30 wt % or less, about 25 wt % or less, about 20 wt % or less, about 15 wt % or less, about 10 wt % or less, or about 5 wt % or less. In embodiments wherein the supported metal comprises a noble metal, the amount of noble metal(s) is typically less than about 2 wt %, for example less than about 1 wt %, about 0.9 wt % or less, about 0.75 wt % or less, or about 0.6 wt % or less.

In various aspects, the conditions selected for hydrocracking for lubricant base stock production can depend on the desired level of conversion, the level of contaminants in the input feed to the hydrocracking stage, and potentially other factors. For example, hydrocracking conditions in a single stage, or in the first stage and/or the second stage of a multi-stage system, can be selected to achieve a desired level of conversion in the reaction system. Hydrocracking conditions can be referred to as sour conditions or sweet conditions, depending on the level of sulfur and/or nitrogen present within a feed. For example, a feed with 100 wppm or less of sulfur and 50 wppm or less of nitrogen, preferably less than 25 wppm sulfur and/or less than 10 wppm of nitrogen, can represent a feed for hydrocracking under sweet conditions. In various aspects, hydrocracking can be performed on a thermally cracked resid, such as a deasphalted oil derived from a thermally cracked resid. In some aspects, such as aspects where an optional hydrotreating step is used prior to hydrocracking, the thermally cracked resid may correspond to a sweet feed. In some aspects, the thermally cracked resid may represent a feed for hydrocracking under sour conditions.

A hydrocracking process can be carried out at temperatures of about 550° F. (~288° C.) to about 840° F. (~449° C.), hydrogen partial pressures of from about 1500 psig to about 5000 psig (~10.3 MPag to ~35 MPag), liquid hourly space velocities of from ~0.05 to ~10 $h^{-1}$, and hydrogen treat gas rates of from ~34 $Nm^3/m^3$ to 1700 $Nm^3/m^3$ (~200 SCF/bbl to ~10000 SCF/bbl). Optionally, the conditions can include temperatures in the range of about 600° F. (~343° C.) to about 815° F. (~435° C.), hydrogen partial pressures of from about 1500 psig to about 3000 psig (~10.3 MPag to ~21 MPag), and hydrogen treat gas rates of from about 200 $Nm^3/m^3$ to about 1100 $m^3/m^3$ (~1200 SCF/bbl to ~6500 SCF/bbl).

Additional Embodiments

Embodiment 1. A ketone wax composition comprising at least about 80 wt % of compounds having a carbon chain length of 27 carbons to 39 carbons (or 30 carbons to 39 carbons), at least about 30 wt % of the compounds having a carbon chain length of 27 carbons to 39 carbons comprising oxygenates, at least a portion of the oxygenates comprising ketones, the ketone wax composition comprising a kinematic viscosity at 100° C. of about 3.0 cSt to about 7.5 cSt and a melting point of at least about 78° C., the compounds having a carbon chain length of 27 carbons to 39 carbons comprising at least about 20 wt % of compounds having a first carbon chain length, at least about 20 wt % of compounds having a second carbon chain length, and at least about 20 wt % of compounds having a third carbon chain length.

Embodiment 2. The ketone wax composition of Embodiment 1, wherein the largest difference in carbon chain length between any two of the first carbon chain length, the second carbon chain length, and the third carbon chain length comprises 6 carbons or less, or 4 carbons or less.

Embodiment 3. The ketone wax composition of any of the above embodiments, wherein the ketone wax composition comprises a) a kinematic viscosity at 100° C. of about 3.0 cSt to about 6.5 cSt, orb) about 6.0 cSt to about 7.5 cSt and a melting point of at least about 83° C.

Embodiment 4. The ketone wax composition of any of the above embodiments, wherein the ketone wax composition comprises at least about 90 wt % (or at least about 95 wt %) of compounds having a carbon chain length of 27 carbons to 39 carbons.

Embodiment 5. The ketone wax composition of any of the above embodiments, wherein at least about 50 wt % (or at least about 80 wt %) of the compounds having a chain length of 27 carbons to 39 carbons comprise oxygenates, ketones, or a combination thereof.

Embodiment 6. The ketone wax composition of any of the above embodiments, wherein about 20 wt % to about 90 wt % of the compounds having a chain length of 27 carbons to 39 carbons comprise olefins, or about 30 wt % to about 80 wt %, or about 40 wt % to about 70 wt %.

Embodiment 7. The ketone wax composition of any of the above embodiments, wherein at least about 80 wt %, or at least about 90 wt %, or at least about 95 wt %, of the compounds having 27 carbons to 39 carbons, or 30 carbons to 39 carbons, have chain lengths that differ by about 6 carbons or less, or about 4 carbons or less.

Embodiment 8. An oligomerized composition comprising at least about 70 wt % of compounds having a carbon chain length of 30 carbons to 70 carbons and about 20 wt % or less of compounds having a carbon chain length of less than 30 carbons, the compounds having a carbon chain length of 30 carbons to 70 carbons comprising about 30 wt % or less of compounds with a double bond equivalent value of 6 for each carbon chain length, about 20 wt % or less of compounds with a double bond equivalent value of 5 for each carbon chain length, and about 20 wt % or less of compounds with a double bond equivalent value of 4 for each carbon chain length.

Embodiment 9. A method for forming a lubricant boiling range composition, comprising: oligomerizing a feed comprising fatty acids, fatty acid derivatives, or a combination thereof to form an oligomerized composition comprising at least about 25 wt % of compounds having a carbon chain length greater than 50 carbons and about 25 wt % or less of compounds having a carbon chain length less than 30 carbons; performing solvent extraction on a lubricant boiling range feedstock to form a raffinate fraction and an extract fraction, the extract fraction comprising a higher wt % of aromatics than the raffinate fraction and/or hydrocracking the lubricant boiling range feedstock to form a hydrocracked effluent; dewaxing at least a first portion of the raffinate fraction under dewaxing conditions to form a dewaxed effluent and/or dewaxing at least a first portion of the hydrocracked effluent under dewaxing conditions to form a dewaxed effluent; hydrofinishing at least a second portion of the raffinate fraction to form a hydrofinished effluent and/or hydrofinishing at least a second portion of the hydrocracked effluent to form a hydrofinished effluent, wherein at least a portion of the oligomerized composition is a) combined with the lubricant boiling feedstock prior to performing the solvent extraction; b) combined with at least one of the first portion of the raffinate fraction and the second portion of the raffinate fraction and/or combined with at least one of the first portion of the hydrocracked effluent and the second portion of the hydrocracked effluent; c) combined with the at least a portion of the dewaxed effluent; d) combined with at least a portion of the hydrofinished effluent; e) combined according to a plurality of a)-d); f) combined according to any two of a)-d); g) combined according to any three of a)-d); or h) combined according to all of a)-d).

Embodiment 10. The method of Embodiment 9, further comprising hydrocracking the at least a first portion of the raffinate fraction prior to the dewaxing.

Embodiment 11. The method of any of Embodiments 9-10, wherein the at least a second portion of the raffinate fraction comprises at least a portion of the dewaxed effluent and/or wherein the at least a second portion of the hydrocracked effluent comprises at least a portion of the dewaxed effluent.

Embodiment 12. The method of any of Embodiments 9-10, wherein the at least a first portion of the raffinate fraction comprises at least a portion of the hydrofinished effluent and/or wherein the at least a first portion of the hydrocracked effluent comprises at least a portion of the hydrofinished effluent; and optionally wherein the dewaxing further comprises forming a hydrocarbon wax product.

Embodiment 13. The method of any of Embodiments 9-12, wherein the dewaxing conditions comprise solvent dewaxing conditions, catalytic dewaxing conditions, or a combination thereof.

Embodiment 14. The method of any of Embodiments 9-13, wherein the lubricant boiling range feedstock comprises about 60 wt % or less of paraffins, or about 30 wt % or less, or about 20 wt % or less.

Embodiment 15. The method of Embodiment 14, wherein the at least a portion of the oligomerized composition is combined with the lubricant boiling feedstock prior to performing the hydrocracking, wherein the hydrofinished effluent comprises at least about 10 wt % of a fraction corresponding to a Group III lubricant basestock, and optionally wherein i) the lubricant boiling range feedstock comprises about 50 wt % or less of paraffins and a viscosity index of about 92 or less, or ii) the lubricant boiling range feedstock comprises about 25 wt % or less of paraffins and a viscosity index of about 40 or less.

Embodiment 16. The method of any of Embodiments 9-15, wherein oligomerizing a feed comprising fatty acids, fatty acid derivatives, or a combination thereof comprises: i) exposing the feed comprising fatty acids, fatty acid derivatives, or a combination thereof to a basic catalyst under first coupling conditions to form a coupled effluent comprising olefinic ketones; and exposing the coupled effluent comprising olefinic ketones to an acidic catalyst under second coupling conditions to form the oligomerized composition; ii) exposing the feed comprising fatty acids, fatty acid derivatives, or a combination thereof to an acidic catalyst and a basic catalyst under coupling conditions to form the oligomerized composition; or iii) a combination of i) and ii).

EXAMPLES

Example 1

Forming Oligomerized Product by Sequential Processing of Soybean Oil

Figure 4:
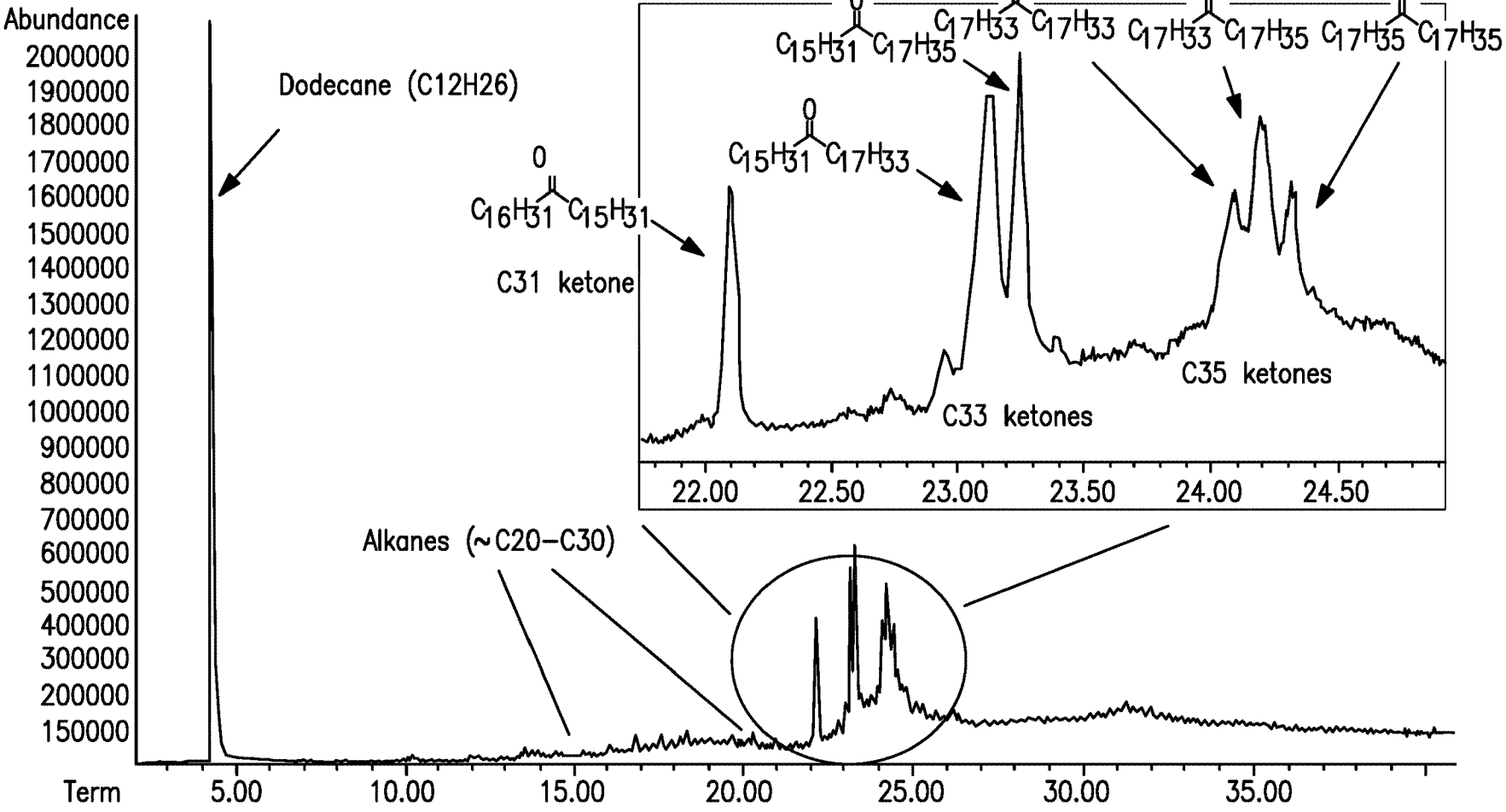
FIG. 4 shows results from processing a fatty acid derivative feed according to an aspect of the invention.

About 2.5 g of soybean oil were reacted over about 0.4 g of Pural® MG hydrotalcite ($MO:Al_2O_3 \approx 63/37$) at about 325° C. and a partial pressure of hydrogen of about 400 psig (~2.8 MPag) for about 24 hours under batch processing conditions. The soybean oil appeared to be completely converted. FIG. 4 shows a gas chromatography/mass spectrometry plot of the product distribution in the product mixture formed from the reaction. The product mixture appeared to contain about 34 wt % olefins and paraffins. The product mixture also appeared to contain about 8 wt %, 25 wt %, and 33 wt % of $C_{31}$, $C_{33}$, and $C_{35}$ ketones, respectively. Based on the natural distribution of fatty acids in soybean oil, the majority of compounds in the product were believed to contain unsaturated double bonds.

The product mixture was then further coupled in the presence of an acidic catalyst under coupling conditions to form various oligomers. About 2 g of the product mixture was reacted over about 0.4 g of MCM-49 at about 300° C. and a partial pressure of hydrogen of about 400 psig (~2.8 MPag) for about 24 hours.

Figure 5:
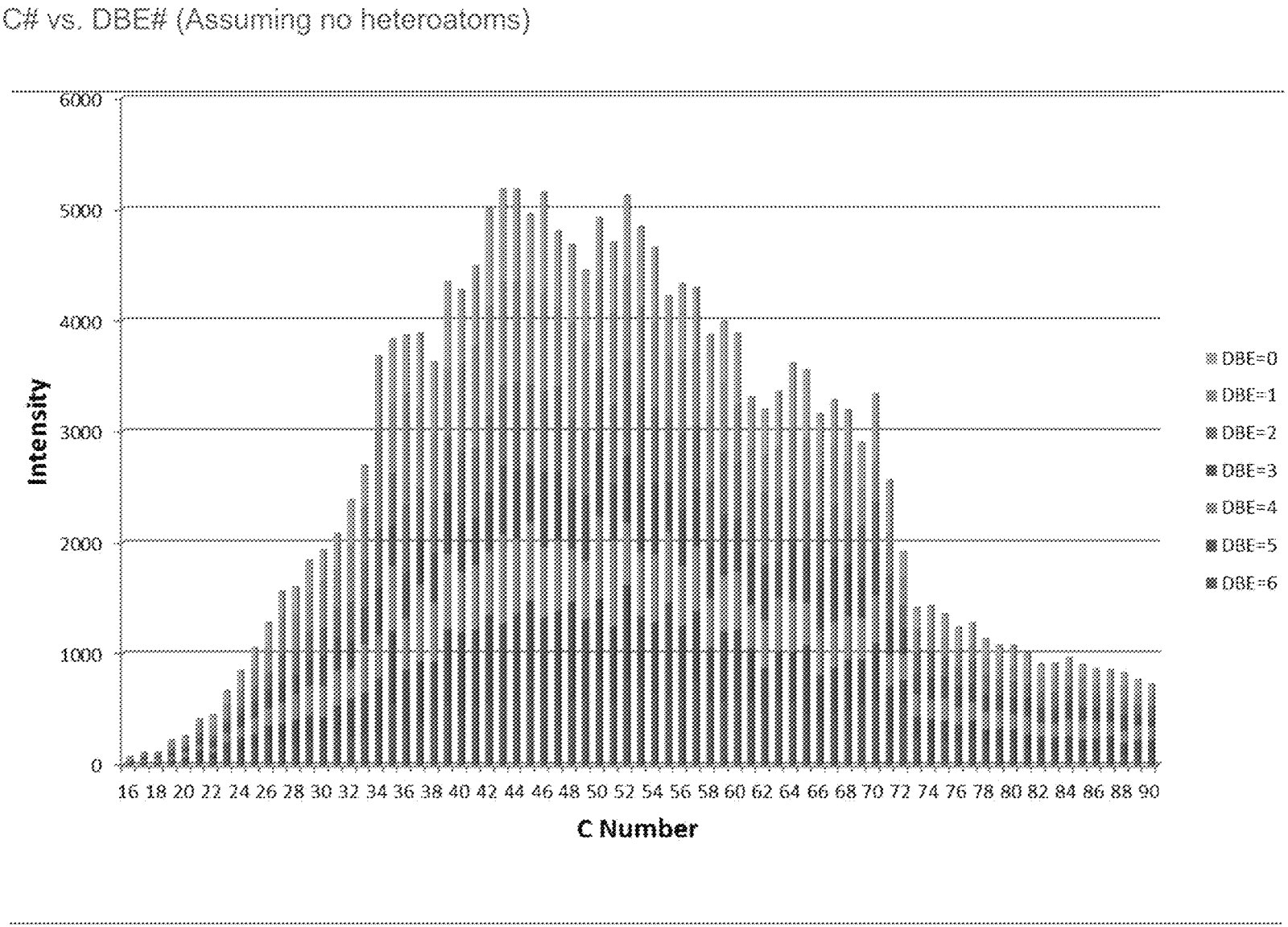
FIG. 5 shows an example of carbon chain lengths and corresponding double bond equivalent values for an oligomerized product.

FIG. 5 shows a flame desorption-time of flight (FD-TOF) mass spectrometry characterization of the resulting oligomerized product formed during oligomerization. FIG. 5 shows the double bond equivalent (DBE) values for each carbon chain length in the oligomerized product. To determine the carbon chain length from the FD-TOF data, it was assumed that the product was free of heteroatoms. For products that corresponded to dimers, trimers, or tetramers from coupling of ketones, approximately 2, 3, or 4 carbons, respectively, were subtracted from the chain length. FIG. 5 appears to show that the resulting oligomerized product had a roughly Gaussian distribution of carbon chain lengths. Additionally, FIG. 5 appears to show that less than about 30 wt % (based on the total intensity) of the products for each carbon chain length had a DBE value of 6; that less than about 20 wt % of the products for each carbon chain length had a DBE value of 5; and that less than about 20 wt % of the products for each carbon chain length had a DBE value of 4.

Example 2

Forming Oligomerized Product by Single Step Processing of Soybean Oil

In this Example, about 2.5 g of soybean oil were reacted over a mixture of MCM-49 and hydrotalcite at about 300° C. and a hydrogen partial pressure of about 400 psig (~2.8 MPag) for about 24 hours under batch processing conditions. The soybean oil appeared to be completely converted.

Figure 6:
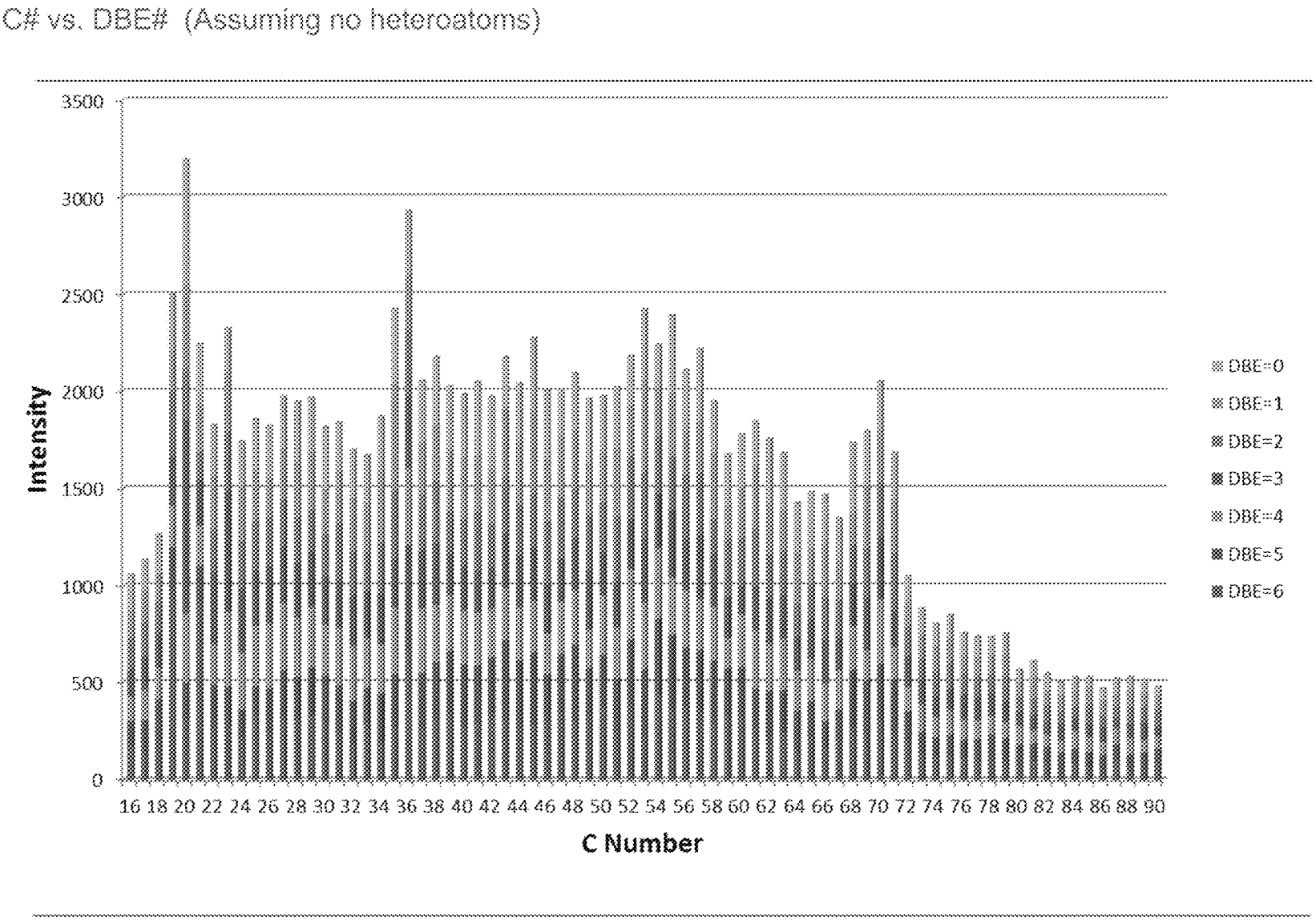
FIG. 6 shows an example of carbon chain lengths and corresponding double bond equivalent values for an oligomerized product.

FIG. 6 shows the FD-TOF results from single step processing of the soybean oil in the presence of both an acidic and a basic catalyst. The resulting product mixture in FIG. 6 does not appear to show a Gaussian distribution of carbon chain lengths. Instead, the intensity for carbon chain lengths closer to the chain lengths present in the original soybean oil feed appeared to be similar to the intensity for dimers and trimers formed from the soybean oil. The intensity then appeared to fall off for carbon chain lengths corresponding to tetramers (or higher oligomers). Additionally, FIG. 6 appears to show that less than about 45 wt % (based on the total intensity) of the products for each carbon chain length had a DBE value of 6; that less than about 20 wt % of the products for each carbon chain length had a DBE value of 5; and that less than about 20 wt % of the products for each carbon chain length had a DBE value of 4.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

The invention claimed is:

1. A ketone wax composition comprising at least about 80 wt % of compounds having a carbon chain length of 27 carbons to 39 carbons, at least about 30 wt % of the compounds having a carbon chain length of 27 carbons to 39 carbons comprising oxygenates, at least a portion of the oxygenates comprising ketones, the ketone wax composition comprising a kinematic viscosity at 100° C. of about 3.0 cSt to about 7.5 cSt and a melting point of at least about 78° C., the compounds having a carbon chain length of 27 carbons to 39 carbons comprising at least about 20 wt % of compounds having a first carbon chain length, at least about 20 wt % of compounds having a second carbon chain length, and at least about 20 wt % of compounds having a third carbon chain length, wherein about 20 wt % to about 90 wt % of the compounds having a chain length of 27 carbons to 39 carbons comprise olefins.

2. The ketone wax composition of claim 1, wherein the largest difference in carbon chain length between any two of the first carbon chain length, the second carbon chain length, and the third carbon chain length comprises 6 carbons or less.

3. The ketone wax composition of claim 1, wherein the ketone wax composition comprises a kinematic viscosity at 100° C. of about 3.0 cSt to about 6.5 cSt.

4. The ketone wax composition of claim 1, wherein the ketone wax composition comprises a kinematic viscosity at 100° C. of about 6.0 cSt to about 7.5 cSt and a melting point of at least about 83° C.

5. The ketone wax composition of claim 1, wherein the ketone wax composition comprises at least about 90 wt % of compounds having a carbon chain length of 27 carbons to 39 carbons.

6. The ketone wax composition of claim 1, wherein at least about 50 wt % of the compounds having a chain length of 27 carbons to 39 carbons comprise oxygenates.

7. The ketone wax composition of claim 1, wherein at least about 50 wt % of the compounds having a chain length of 27 carbons to 39 carbons comprise ketones.

8. The ketone wax composition of claim 1, wherein at least about 80 wt % of the compounds having 27 carbons to 39 carbons have chain lengths that differ by about 6 carbons or less.

* * * * *